US005705996A

United States Patent [19]

Eguchi et al.

[11] Patent Number: 5,705,996

[45] Date of Patent: Jan. 6, 1998

[54] TOLL COLLECTION SYSTEM

[75] Inventors: Osamu Eguchi, Kuwana; Yoshiyuki Kago, Nishio, both of Japan

[73] Assignee: Nippondenso Co., Ltd., Kariya, Japan

[21] Appl. No.: 625,283

[22] Filed: Apr. 1, 1996

[30] Foreign Application Priority Data

Mar. 30, 1995 [JP] Japan ..... 7-074087

[51] Int. Cl.[6] ..... G08G 1/00

[52] U.S. Cl. ..... 340/928; 340/933; 340/937

[58] Field of Search ..... 340/928, 933, 340/937, 942; 235/384, 380; 348/148, 149, 164; 364/456, 464.01

[56] References Cited

U.S. PATENT DOCUMENTS

| | | | |
|---|---|---|---|
| 4,338,587 | 7/1982 | Chiappetti | 340/928 |
| 5,086,389 | 2/1992 | Hassett et al. | 340/928 |
| 5,101,200 | 3/1992 | Swett | 340/937 |
| 5,253,162 | 10/1993 | Hassett et al. | 340/928 |
| 5,289,183 | 2/1994 | Hassett et al. | 340/928 |
| 5,451,758 | 9/1995 | Jesdadanont | 340/928 |
| 5,485,520 | 1/1996 | Chaum et al. | 235/384 |

FOREIGN PATENT DOCUMENTS

| | | | |
|---|---|---|---|
| 0 616 302 | 9/1994 | European Pat. Off. | G07B 15/00 |
| 4-315282 | 11/1992 | Japan | G07B 15/00 |
| 5-314325 | 11/1993 | Japan | G06K 17/00 |
| 6-131509 | 5/1994 | Japan . | |

*Primary Examiner*—Jeffery Hofsass
*Assistant Examiner*—Van T. Trieu
*Attorney, Agent, or Firm*—Cushman, Darby & Cushman IP Group of Pillsbury, Madison & Sutro LLP

[57] ABSTRACT

The present invention provides an automobile toll system which may determine accurately whether a device mounted on a vehicle has a mismatch even when a small automobile is running just behind a large automobile and therefore blocked from communicating with the toll system. In the system, a vehicle type discriminator determines the type of a vehicle passing therethrough based on its shape and weight and transmits determination data to a lane controller. A controller for a reading antenna continuously transmits vehicle type data retrieved from a response signal from the vehicle-mounted device when vehicles stay in the antenna communication area. The lane controller compares type discrimination data and vehicle type data for each vehicle in the order of vehicles leaving the communication area to recognize a mismatch if the data are different.

10 Claims, 25 Drawing Sheets

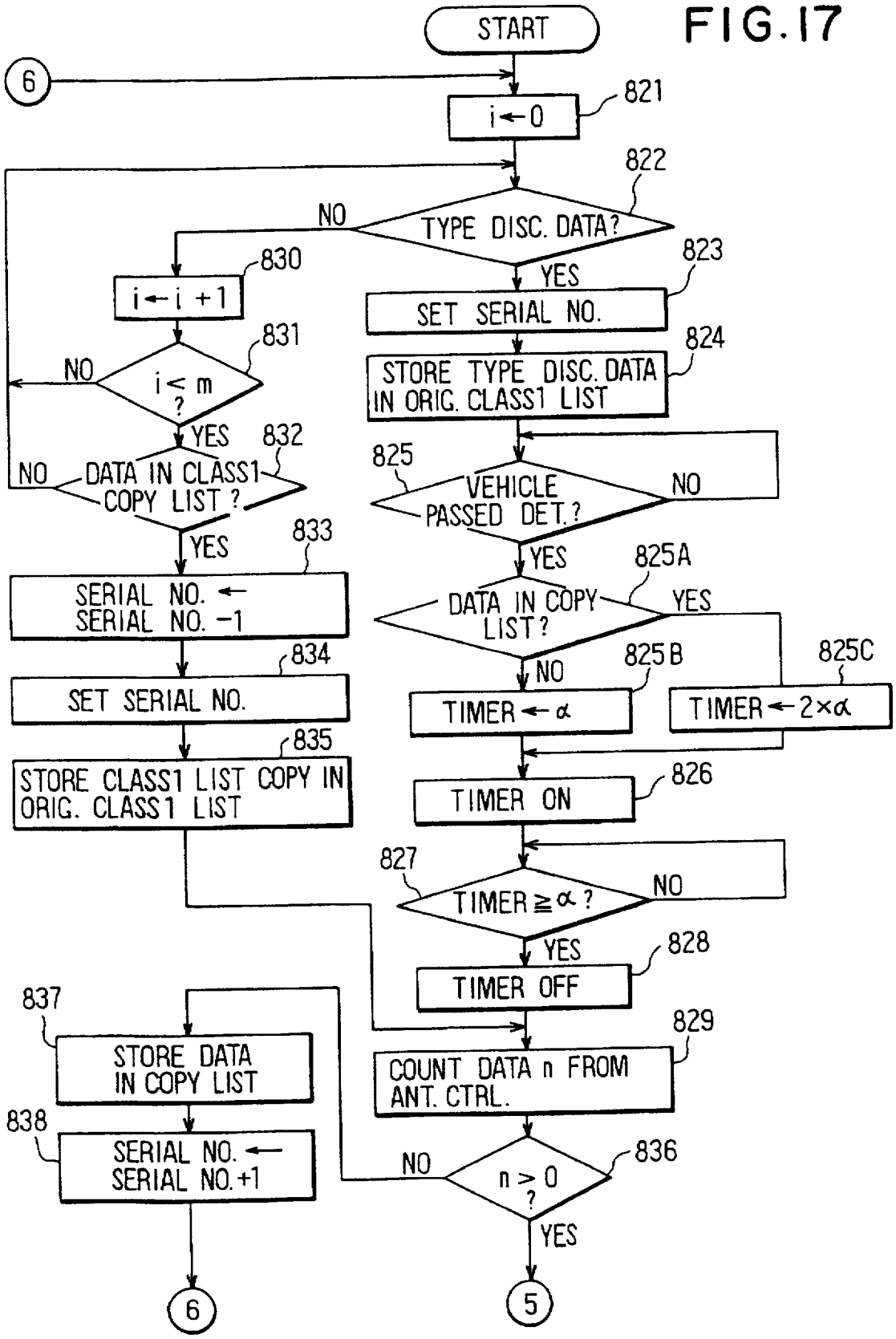
FIG.17
START
6
i←0
821
822
TYPE DISC. DATA?
NO
YES
823
SET SERIAL NO.
824
STORE TYPE DISC. DATA IN ORIG. CLASS1 LIST
825
VEHICLE PASSED DET.?
NO
YES
825A
DATA IN COPY LIST?
YES
NO
825B
TIMER ← α
825C
TIMER ← 2×α
826
TIMER ON
827
TIMER ≧ α ?
NO
YES
828
TIMER OFF
829
COUNT DATA n FROM ANT. CTRL.
836
n > 0 ?
NO
YES
5
830
i←i+1
831
i < m ?
NO
YES
832
DATA IN CLASS1 COPY LIST ?
NO
YES
833
SERIAL NO. ← SERIAL NO. −1
834
SET SERIAL NO.
835
STORE CLASS1 LIST COPY IN ORIG. CLASS1 LIST
837
STORE DATA IN COPY LIST
838
SERIAL NO. ← SERIAL NO.+1
6

FIG. 20A

| SERIAL NO. | 1 | 2 | 3 | 4 | 5 | 6 |
|---|---|---|---|---|---|---|
| class 1 | | | | | | |
| class 2 | | | | | | |

FIG. 20B

| SERIAL NO. | | | | | | |
|---|---|---|---|---|---|---|
| class 1 | | | | | | |
| class 2 | | | | | | |

FIG. 22A

| SERIAL NO. | 1 | 2 | 3 | 4 | 5 | 6 |
|---|---|---|---|---|---|---|
| class 1 | 6B | | | | | |
| class 2 | 6B | | | | | |

OK

FIG. 22B

| SERIAL NO. | | | | | | |
|---|---|---|---|---|---|---|
| class 1 | | | | | | |
| class 2 | | | | | | |

FIG. 23A

| SERIAL NO. | 1 | 2 | 3 | 4 | 5 | 6 |
|---|---|---|---|---|---|---|
| class 1 | 6B | 2 | | | | |
| class 2 | 6B | | | | | |
| | OK | | | | | |

FIG. 23B

| SERIAL NO. | 2 | | | | | |
|---|---|---|---|---|---|---|
| class 1 | 2 | | | | | |
| class 2 | | | | | | |

FIG. 24A

| SERIAL NO. | 1 | 2 | 3 | 4 | 5 | 6 |
|---|---|---|---|---|---|---|
| class 1 | 6B | 2 | 4N | | | |
| class 2 | 6B | | 4N | | | |
| | OK | | OK | | | |

FIG. 24B

| SERIAL NO. | 2 | | | | | |
|---|---|---|---|---|---|---|
| class 1 | 2 | | | | | |
| class 2 | | | | | | |

FIG. 25A

| | | | | | | |
|---|---|---|---|---|---|---|
| SERIAL NO. | 1 | 2 | 3 | 4 | 5 | 6 |
| class 1 | 6B | 2 | 4N | | | |
| class 2 | 6B | | 2 | | | |
| | OK | | NG | | | |

FIG. 25B

| | | | | | | |
|---|---|---|---|---|---|---|
| SERIAL NO. | 2 | | | | | |
| class 1 | 2 | | | | | |
| class 2 | | | | | | |

FIG. 26A

| | | | | | | |
|---|---|---|---|---|---|---|
| SERIAL NO. | 1 | 2 | 3 | 4 | 5 | 6 |
| class 1 | 6B | 2 | 4N | | | |
| class 2 | 6B | 2 | 4N | | | |
| | OK | OK | OK | | | |

FIG. 26B

| | | | | | | |
|---|---|---|---|---|---|---|
| SERIAL NO. | | | | | | |
| class 1 | | | | | | |
| class 2 | | | | | | |

TOLL COLLECTION SYSTEM

CROSS-REFERENCE TO RELATED APPLICATIONS

The present application is related to and claims priority from Japanese Patent Application No. Hei. 7-74087, incorporated herein by reference.

BACKGROUND OF THE INVENTION

1. Field of the Invention

The present invention relates to a toll system for conducting toll operations between vehicles such as automobiles and toll gates using telecommunications.

2. Description of the Related Art

A toll system for expressways and other thoroughfares is disclosed in Japanese Patent Laid-Open Publication No. Hei. 6-131509. In this system, type discrimination data of a plurality of vehicles passing through a vehicle type discriminator is transferred to its controller in the order of passage therethrough. When these vehicles enter a communication area, the controller performs toll operations with the vehicles in the order in which the vehicles pass through the vehicle type discriminator.

In the conventional toll system mentioned above, when (for example) a large-sized car, a motorcycle and a medium-sized car pass through the vehicle type discriminator in that order, the controller attempts to perform toll operations on the vehicles in that order. However, if the vehicles pass through the discriminator in that order, the motorcycle will be hidden behind the large-sized car, so that there may be cases in which a tolling operation to be performed with the motorcycle may mistakenly be done with the subsequent medium-sized car. Therefore, proper toll operation cannot be achieved.

SUMMARY OF THE INVENTION

In view of the above-described problems in the prior art, an object of the present invention is to provide a system which conducts accurate toll operations even when a small vehicle runs just behind a large-sized car.

The above object is achieved in a first aspect of the present invention by providing a vehicle type discriminator which generates vehicle type data by determining the type of a vehicle based at least on the shape of the vehicle, where a device mounted on that vehicle uses an antenna to receive a response signal which includes vehicle type data. A comparator compares the response signal data with its own vehicle type data to output signal to external device if there is a mismatch (e.g., to close the gate or to report to the administration office that there is a malfunction).

According to the present invention, when, for example, a large-sized car, a motorcycle and a medium-sized car are running in that order on a road and the motorcycle is hidden just behind the large vehicle ahead of it, the vehicle type data received from the device on the vehicle through the antenna is used by the comparator at the time the device on a vehicle reaches a position at which a line between the device on the vehicle and the antenna becomes approximately perpendicular to the direction of vehicle travel.

In other words, at the perpendicular position, no vehicle can be hidden behind the vehicle ahead. The order of vehicle type data will be, in the above mentioned case, a large-sized car, a motorcycle, and a medium-sized car if there is no mismatch.

As can be seen, the present invention may accurately determine whether there is a mismatch with between a roadside station and a device mounted on a vehicle, even in a situation where a smaller vehicle is running just behind a larger one ahead.

Preferably, the system includes entry detector means and reception determination means so that the reception determination means may determine when the antenna receives no response signal from a device on a vehicle within a predetermined period of time, in other words, verify if a smaller vehicle is hidden behind a larger vehicle, so that the antenna cannot receive response signal from the device on that vehicle even within the communication area. If the reception determination means determines that no response signal is received within a predetermined period of time, the vehicle type data for that vehicle is stored in memory.

Thereafter, if the antenna later receives a response signal that might have been received within that period of time, the comparator compares the vehicle type data incorporated in the response signal with the vehicle type data stored in the memory. If there is no mismatch, the result of this comparison shows no difference, and if there is, the result shows a difference.

According to another aspect of the present invention, the above objects are achieved by providing a toll system including a toll charging apparatus and devices mounted on vehicles. The antenna of a vehicle-mounted device is provided at a location so that it can transmit to the antenna of the toll charging apparatus when the device on the vehicle reaches a position where the line between the device and the antenna of the system is approximately perpendicular to the direction of vehicle travel. Accordingly, the toll system may accurately determine whether there is a mismatch between the toll charging apparatus and a device on a vehicle in a situation in which a small vehicle is running just behind a larger vehicle.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which:

FIGS. 17–19 are a flowchart of processing in a lane controller in the second embodiment;

FIGS. 20A and 20B are primary and secondary lists, respectively, of the second embodiment;

FIGS. 22A and 22B respectively are primary and secondary lists of an aspect of data storage into each list at time t2 in FIG. 21;

FIGS. 23A and 23B respectively are primary and secondary lists of an aspect of data storage into each list at time t6 in FIG. 21;

FIGS. 24A and 24B respectively are primary and secondary lists of an aspect of data storage into each list at time t8 in FIG. 21;

FIGS. 25A and 25B respectively are primary and secondary lists of an aspect of data storage into each list at time t8 in FIG. 21;

FIGS. 26A and 26B respectively are primary and secondary lists of an aspect of data storage into each list at the time t8 of FIG. 21, with FIG. 26A showing a primary list and FIG. 26B showing a secondary list;

DETAILED DESCRIPTION OF THE PRESENTLY PREFERRED EXEMPLARY EMBODIMENTS

A first preferred embodiment of the present invention as applied to a toll system at an automated toll gate of an expressway will be described in greater detail below with reference to the appended drawings.

Figure 1:
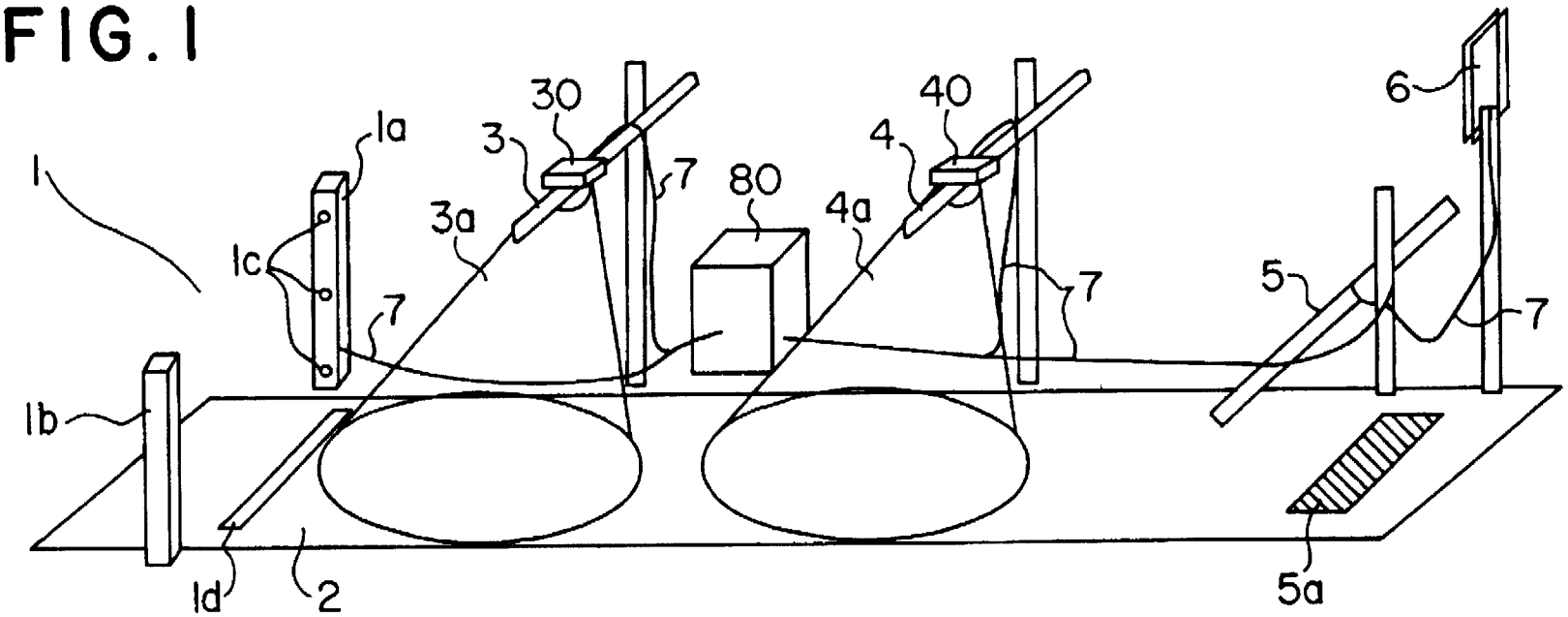
FIG. 1 is a schematic perspective view of a toll system according to a first embodiment of the present invention.

FIG. 1 shows a roadside toll charging apparatus. In FIG. 1, reference numeral 1 designates a vehicle type discriminator for determining the type of a vehicle passing therethrough based on, for example, the shape (e.g., the length and height), weight, and number of wheels of a vehicle.

The vehicle type discriminator i includes a pair of posts 1*a* and 1*b*, a plurality of light emitting elements (for example, infrared light emitting elements) 1*c* provided on one of the posts 1*a* along its height, a plurality of photoreceptor elements (not shown) provided on the opposite post at positions corresponding to the light emitting elements 1*c*, a foot plate 1*d* provided on the road surface at a position slightly ahead of the posts 1*a* and 1*b*, and a weight sensor (not shown) provided beneath the foot plate foot plate 1*d*.

In addition, the light emitting elements 1*c*, photoreceptors, the foot plate 1*d*, and the weight sensor are connected to a controller 10 (shown in FIG. 2) for the vehicle type discriminator. The controller 10 includes a microprocessor having an input/output interface, ROM, RAM, CPU, etc., where (as shown in FIG. 3) the CPU performs processing to determine the type of vehicle passing between the posts 1*a* and 1*b* based on the length, height, weight, number of wheels, etc. of that vehicle.

In FIG. 1, reference numeral 3 denotes an antenna dedicated for reading, which is located at a position above the road 2 and above the vehicles. The reading antenna 3 is connected to a controller 30 for the reading antenna which includes a microprocessor having an input/output interface, ROM, RAM, CPU, etc.

The CPU of the controller 30 periodically transmits a request signal in a range from just below the reading antenna 3 to a position a predetermined distance behind the antenna, in order to generate a communication area 3*a* for the reading antenna 3 thereby. Thus, when a vehicle leaves the communication area 3*a*, the communication area 3*a* is approximately perpendicular to the direction of travel of that vehicle.

Figure 5:
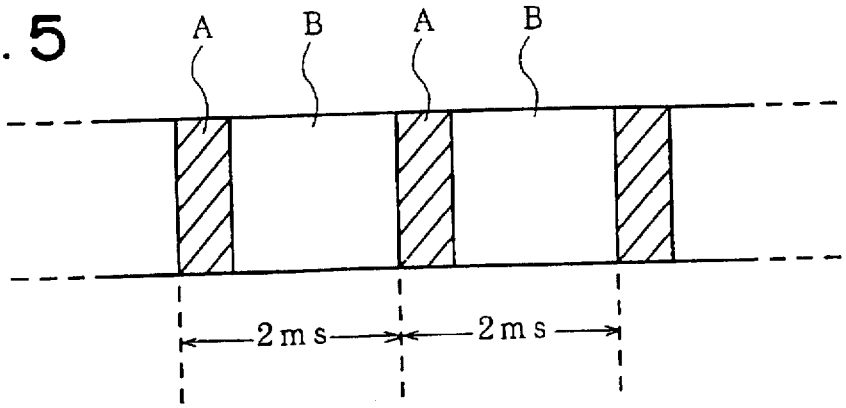
FIG. 5 is a timing chart indicating aspects of request signal timing in the first embodiment.
Figure 32A:
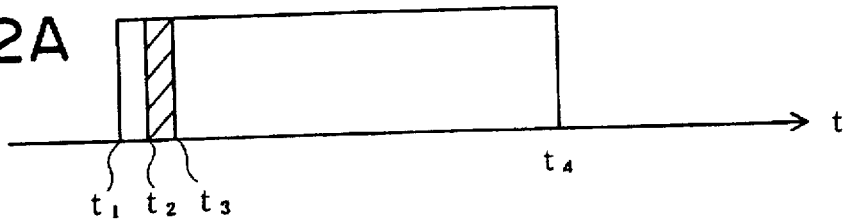
FIGS. 31–33 illustrate modifications of the above embodiments.
Figure 32B:
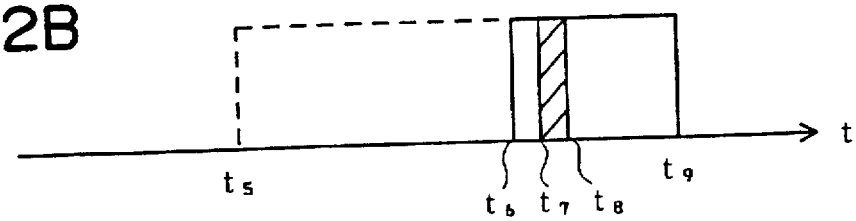
Figure 32C:
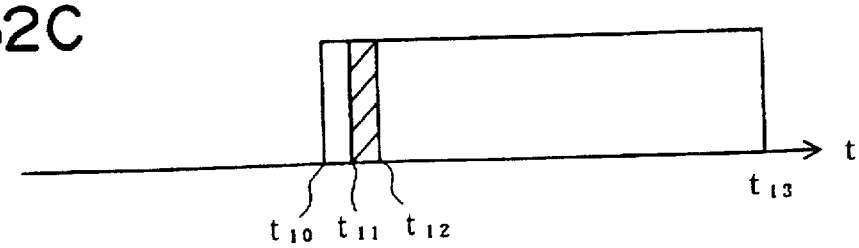

The request signal is, more specifically, as shown in FIG. 5, a signal including a modulated pilot signal A and a carrier B with no modulation which are alternately transmitted at a predetermined cycle (e.g., 2 ms). The pilot signal A incorporates ID data identifying that this pilot signal is transmitted from the reading antenna 3.

In FIG. 1, reference numeral 4 designates a writing antenna, which is located over the road 2 and above the vehicles. The writing antenna 4 is connected to a microprocessor having an input/output interface, ROM, RAM, CPU, etc.

The CPU of the controller 40 periodically transmits request signals in a range from just below the reading antenna 4 to a position a predetermined distance behind the antenna (i.e., the left hand side of FIG. 1), in order for the request signals (i.e., the pilot signal and carrier) to define a communication area 4*a* for the writing antenna 4 thereby.

Reference numeral 5 in FIG. 1 designates a gate for allowing or inhibiting the passage of vehicles by opening or closing road 2. A numeral 5*a* designates a foot plate provided at a position slightly ahead of the gate in the direction of vehicle travel. Reference numeral 6 is an indicator for displaying messages to notify drivers of the status of the gate 5.

The gate 5, foot plate 5*a*, and indicator 6 are connected to a controller 50 (shown in FIG. 2) having an input/output interface, ROM, RAM, CPU, etc. The CPU of the controller 50 processes controls the activation of the gate 5 and the display of the indicator 6.

Reference numeral 80 designates a lane controller which is connected through communication link 7 to the controllers 10, 30, 40, and 50. The lane controller 80 incorporates a microprocessor having an input/output interface, ROM, RAM, CPU, etc. The CPU retrieves data from the controller 10 and the controller 30 through the communication link 7 to perform processing as described below based on that data and outputs the results through the communication link 7 to the controller 40 and controller 50.

Figure 2:
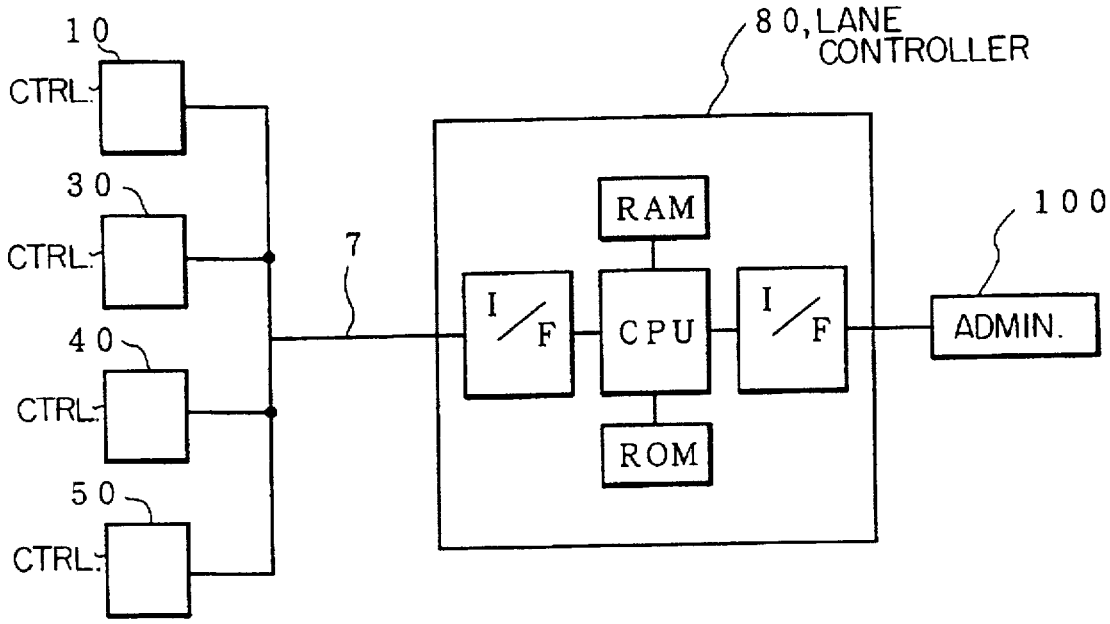
FIG. 2 is a schematic block diagram of a control system of the first embodiment.
Figure 3:
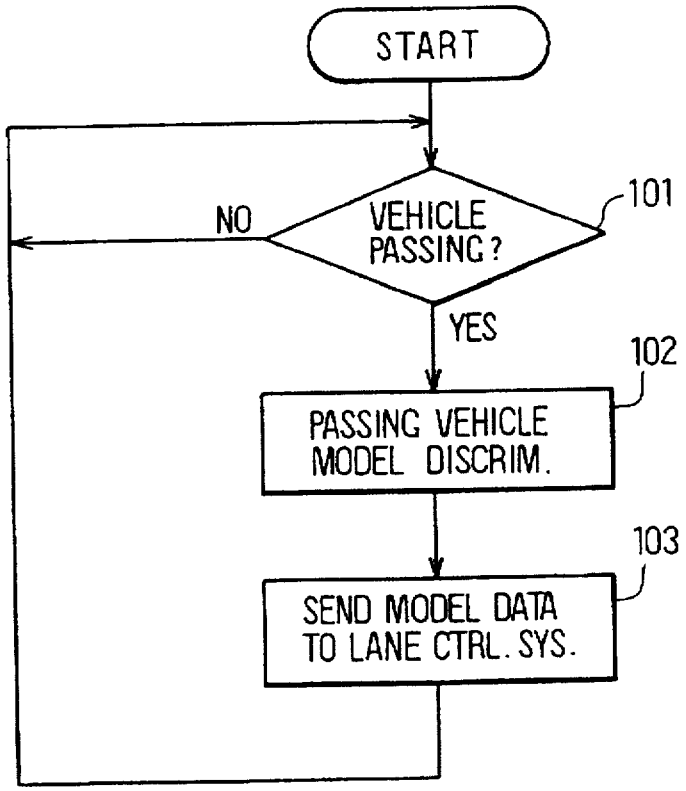
FIG. 3 is a flowchart of processing in a controller of a vehicle type discriminator in the first embodiment.

Interconnection between respective controllers according to the present embodiment is shown in FIG. 2. In FIG. 2, the lane controller 80 is further connected to an administration computer 100. The administration computer 100 automatically performs bank wire transfers from accounts of drivers based on the toll charge operations.

Although not shown in FIG. 1, each vehicle includes a device for communicating with the controller 30 for the reading antenna 3 or the controller 4 for the writing antenna 40. Each vehicle-mounted device is provided with an antenna for receiving a pilot signal from the reading antenna 3 or the writing antenna 4, and for transmitting a pilot response signal (described below) to the reading antenna 3 or writing antenna 4.

The antenna is mounted on a vehicle at a position in which the pilot signal may be received in a forward or approximately downward direction (for example, at an inner surface of the windshield). A microprocessor including an input/output interface, ROM, RAM, CPU, etc., is provided in the vehicle-mounted device.

Data such as vehicle type data and ID (a unique identification number for the respective vehicle) is stored in the ROM of the vehicle-mounted device. Data necessary for determining the toll charge (such as issued site and issued date) is stored in the RAM of the vehicle-mounted device.

When the vehicle-mounted device enters a communication area 3*a* or 4*a* and receives a pilot signal from the reading antenna 3, the CPU in the vehicle-mounted device transmits the pilot response signal incorporating the vehicle type data and ID and data necessary for determining the charge to the respective controller 30 and 40.

The processing of the respective controllers 10, 30, 40, 50, 80, and the CPU of the vehicle-mounted device will be now described.

At first, the processing of the CPU of the controller 10 for the vehicle type discriminator will be described below with reference to FIG. 3.

When powering up the controller 10, the routine shown in FIG. 3 will be executed. Step 101 determines whether a vehicle is just passing between the column post members 1*a* and 1*b*. More specifically, Step 101 determines whether any photoreceptor is off (i.e., because a vehicle is blocking its corresponding light emitting element).

If any of photoreceptors is off, a vehicle is considered to be passing between the column post members 1*a* and 1*b*. The system determines whether all of the photoreceptors are on again, and a wheel passes over the foot plate 1*d* thereafter. If all of the photoreceptors turn on and a wheel passes over the foot plate 1*d*, it is determined that a vehicle has been just passed between the column post members 1*a* and 1*b*; therefore, the result of the decision in Step 101 is YES. Otherwise, the result is NO.

In Step 102, the type of that vehicle is determined based on the photoreceptor on/off transitions during vehicle passage through between column post members 1*a* and 1*b*, and the weight sensor determines the weight of the vehicle as well as the number of passages of wheels on the foot plate 1*d* (i.e., the number of wheels). In Step 103, the data determined in Step 102 is transmitted to the RAM of the lane controller 80, and thereafter processing returns to Step 101.

The processing of the CPU of the controller 30 for the reading antenna 3 will be described below with reference to FIG. 4.

Figure 4:
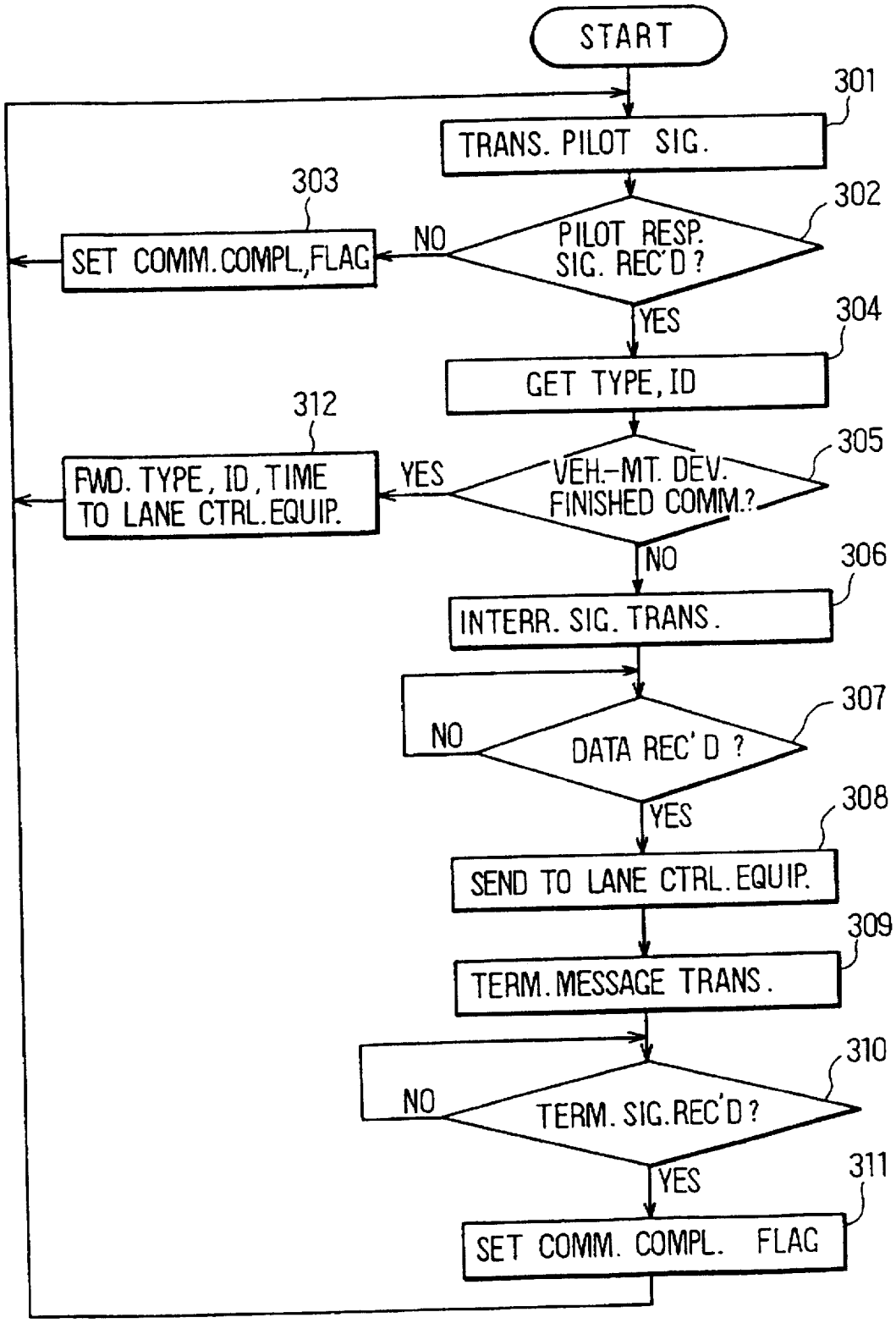
FIG. 4 is a flowchart of processing in the controller of a reading antenna in the first embodiment.

When powering up the controller 30 for the reading antenna, the routine of FIG. 4 will be executed. In Step 301, the pilot signal and carrier are alternately transmitted.

Step 302 determines whether a pilot response signal corresponding to this pilot signal has been received. If such a pilot signal has not been received, the communication termination flag is reset in Step 303 and execution returns to Step 301 to again alternately transmit the pilot signal and carrier. The communication termination flag is in the reset status by default when the routine of FIG. 4 is initially executed.

On the contrary, if the system has received the pilot response signal, Step 304 retrieves the vehicle type data and ID incorporated in the received pilot response signal.

Step 305 determines whether the vehicle-mounted device which has just transmitted the pilot response signal has already terminated the communication processes in Step 306 to 310 described below, based on the status of the communication termination flag.

If the communication processes have not been terminated in Step 305, Step 306 transmits a request signal for reading from the vehicle-mounted device which is necessary to determine the charge (such as issued site, issued date, etc.).

Step 307 waits for the reception of the data from the device on a vehicle corresponding to the request signal. When receiving data, Step 308 transfers the data to the RAM of the lane controller 80.

Step 309 sends a termination message notifying the vehicle-mounted device that the data communication has been terminated. Step 310 waits for the reception of a termination response signal from the device on a vehicle corresponding to the termination message. When the termination response signal has been received, Step 311 stores the communication termination flag to signify the termination of communication, and processing returns to Step 301.

On the other hand, if Step 305 determines that the vehicle-mounted device which transmitted the pilot response signal has already completed the communication process, Step 312 transmits the vehicle type data and ID that were retrieved in Step 304 and the vehicle entry time to the RAM of the lane controller 80, and processing returns to Step 301. This means that while a device on a vehicle which already has terminated the communication process once is staying within the communication area 3*a*, the controller 30 for the reading antenna continues to transmit the vehicle type data, ID and the entry time of this vehicle-mounted device to the lane controller lane controller 80.

The processing of the CPU of the lane controller 80 will be described below with reference to FIG. 6.

Figure 6:
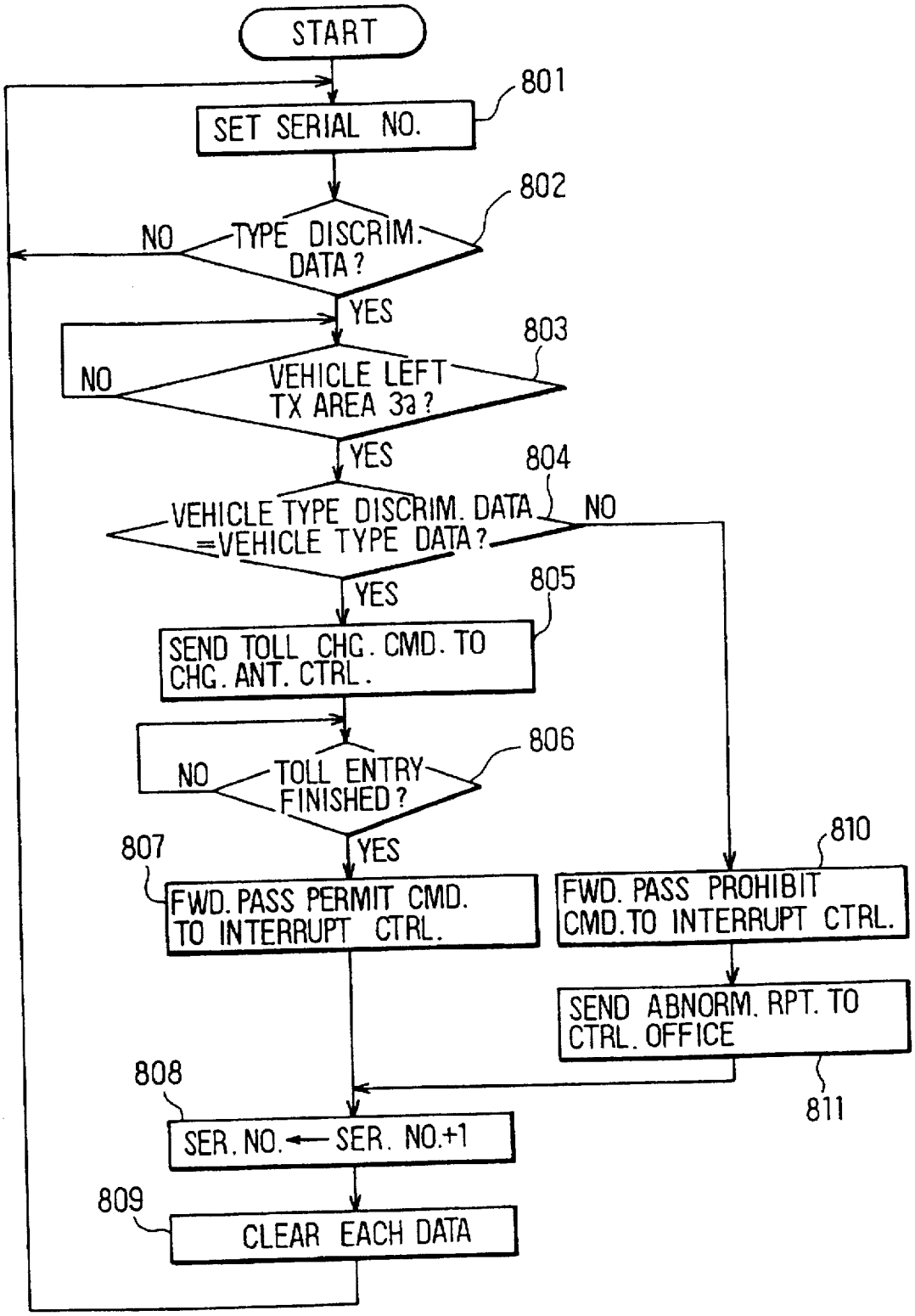
FIG. 6 is a flowchart of processing in a lane controller in the first embodiment.

When powering up the lane controller 80, the routine shown in FIG. 6 will be executed, wherein Step 801 sets a serial number. This serial number is set to a predetermined number (for example, 1) by default when the routine of FIG. 6 is executed for the first time.

Step 802 determines if the vehicle type data from the controller 10 for vehicle type discriminator has been transmitted to see whether a vehicle has passed through the vehicle type discriminator 1. If Step 802 determines that the data is not transferred (i.e., no vehicle has passed through), processing returns to Step 801 to set the same serial number. Alternatively, if Step 802 determines that the data has been transferred (i.e., a vehicle has passed), the processing proceeds to Step 803 to determine whether that vehicle has left the communication area 3*a*.

More specifically, Step 803 makes the determination based on the status of the flag which is set when the vehicle type data, ID and the vehicle entry time transferred from the controller 30 for the reading antenna 3 is not varied during a predetermined period of time. If the flag is set, then the result of the decision in Step 803 is YES.

In other words, when a vehicle stays within the communication area 3a, the controller 30 for the reading antenna repetitively performs Step 312, so the time to be transferred to the RAM of the lane controller 80 will be varied constantly. However, when the vehicle leaves the communication area 3a, the controller 30 stops performing Step 312, so the time to be transferred to the RAM of the lane controller 80 will not be changed.

In the present embodiment, the vehicle is determined to have left the communication area 3a if the time does not change for a predetermined period of time. Here, the predetermined period of time refers to the duration corresponding to a period of time sufficient to recognize that a vehicle has left the communication area 3a, as an expiration since no change of the time has occurred. In this embodiment this predetermined period of time is preferably 10 ms.

Step 804 determines whether the type discrimination data transferred from the controller 10 for the vehicle type discriminator is identical to the type data transferred from the controller 30 for the reading antenna 3. This allows the system to determine whether that vehicle-mounted device has a mismatch (for example, a device for a motorcycle is attached to an automobile), as well as whether a vehicle having passed the vehicle type discriminator 1 overtakes another one running ahead within the communication area 3a.

If the result of the decision in Step 804 is YES, there is no mismatch in the vehicle-mounted device, and the vehicle is considered not to have overtaken another vehicle within the communication area 3a, so that Step 805 transfers the serial number, data necessary for the determination of the toll charge, vehicle type data, and ID, together with a charge writing instruction which indicates that the charge may be written to this vehicle-mounted device, to the RAM of the controller 40 for the writing antenna 4.

Step 806 determines whether the writing antenna 4 terminates the writing of the charges to the vehicle-mounted device by determining whether the controller 40 for the writing antenna 4 transmitted the results of tolling to repeat the process of Step 806 until writing is determined to be terminated. When writing is determined to be terminated, Step 807 transfers the currently set serial number along with a passing instruction which permits the passing of a vehicle to the RAM of the controller 50 for the gate. Step 808 increments the serial number, and Step 809 clears the data required for the determination of the charge, vehicle type data, and ID. Then, processing returns to Step 801.

On the other hand, Step 804 determines that, if the vehicle type data is different from the type discrimination data, there may be a mismatch in the vehicle-mounted device, or that this vehicle has overtaken another one within the communication area 3a. Step 810 transfers the currently set serial number together with a no-passing instruction which prohibits the passing of that vehicle to the RAM of the controller 50 for the gate. Step 811 reports the occurrence of an abnormal event to the administration office. Thereafter, processing returns to Step 808.

The processing of the CPU of the controller 40 for the writing antenna 4 will be described below with reference to FIG. 7.

Figure 7:
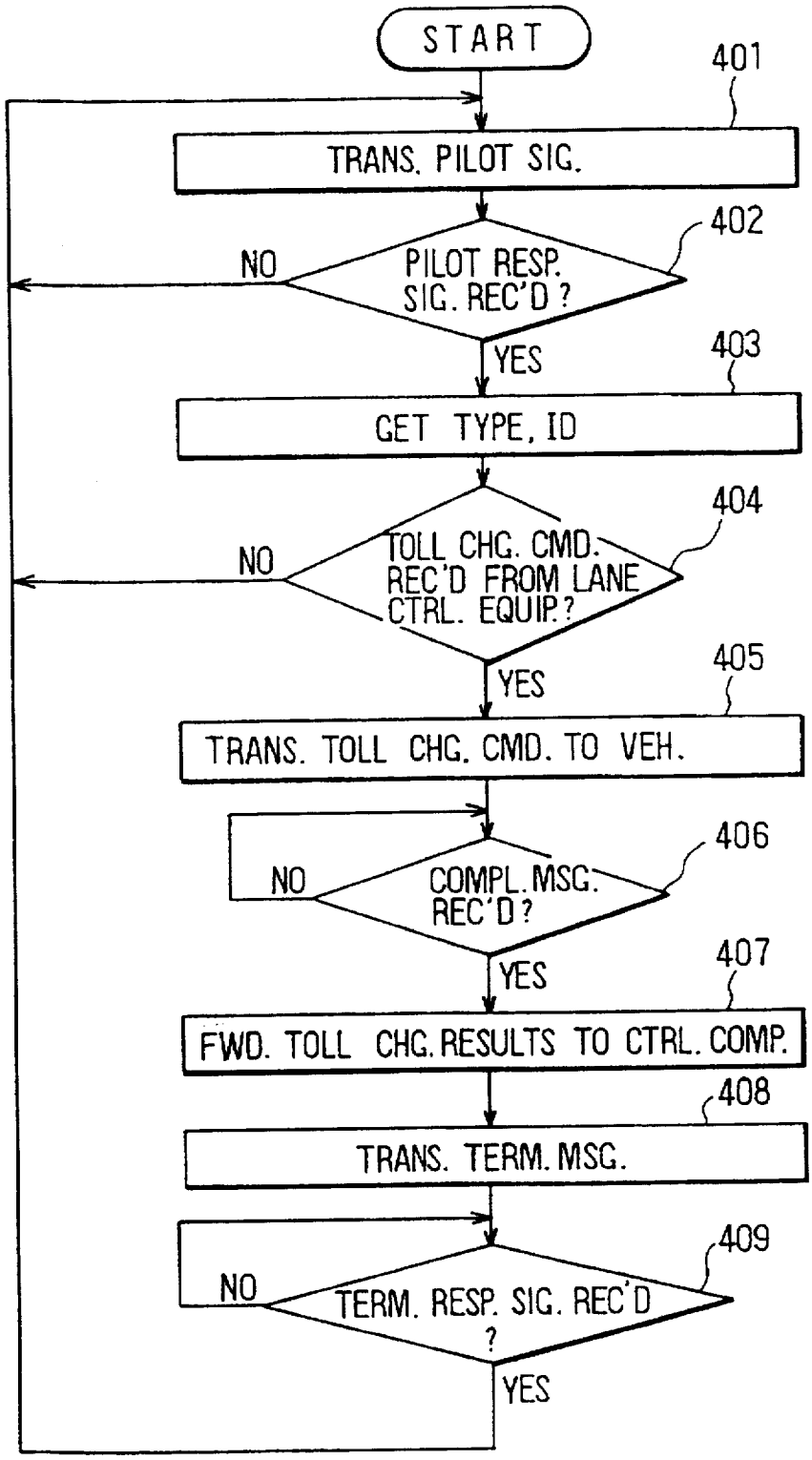
FIG. 7 is a flowchart of processing in a controller for a writing antenna in the first embodiment.

When powering up the controller 40 for the writing antenna 4, the routine shown in FIG. 7 will be executed. Then, in Step 401, as shown in FIGS. 4 and 5, modulated pilot signal A and non-modulated carrier B are alternately transmitted at a given cycle (in this embodiment, 2 ms). The pilot signal includes an ID which indicates that this pilot signal is transmitted from the writing antenna 4.

Step 402 determines whether a pilot response signal corresponding to this pilot signal has been received. If not, the processing returns to Step 401 to again transmit the pilot signal and carrier alternately. On the contrary, if the pilot signal has been received, the vehicle type data and ID incorporated in the received pilot response signal are retrieved in Step 403.

Step 404 determines whether a toll charge writing instruction corresponding to the vehicle type data and ID retrieved in Step 403 has been transmitted from the lane controller 80. If not, processing returns to Step 801 since, as described above, there may be a mismatch in the vehicle-mounted device, or the vehicle may have overtaken another one within the communication area 3a.

On the other hand, if the toll charge writing instruction has been transferred in Step 404, this means that the device on that vehicle has no mismatch and the vehicle did not overtake another vehicle in the communication area 3a. Thus, Step 405 determines the amount of charge according to the data necessary for the determination of the charge that has been transferred from the lane controller 80, and the charge writing instruction which instructs the system to write the determined charge into the vehicle-mounted device will be transmitted.

Step 408 transmits a termination message that notifies the vehicle-mounted device that the data communication has been terminated. Step 409 waits for the reception of the termination response signal from the vehicle-mounted device corresponding to the termination signal. When receiving the termination response signal, processing returns to Step 401.

The processing of the CPU of the controller 50 for the gate 5 will be described below with reference to FIG. 8.

Figure 8:
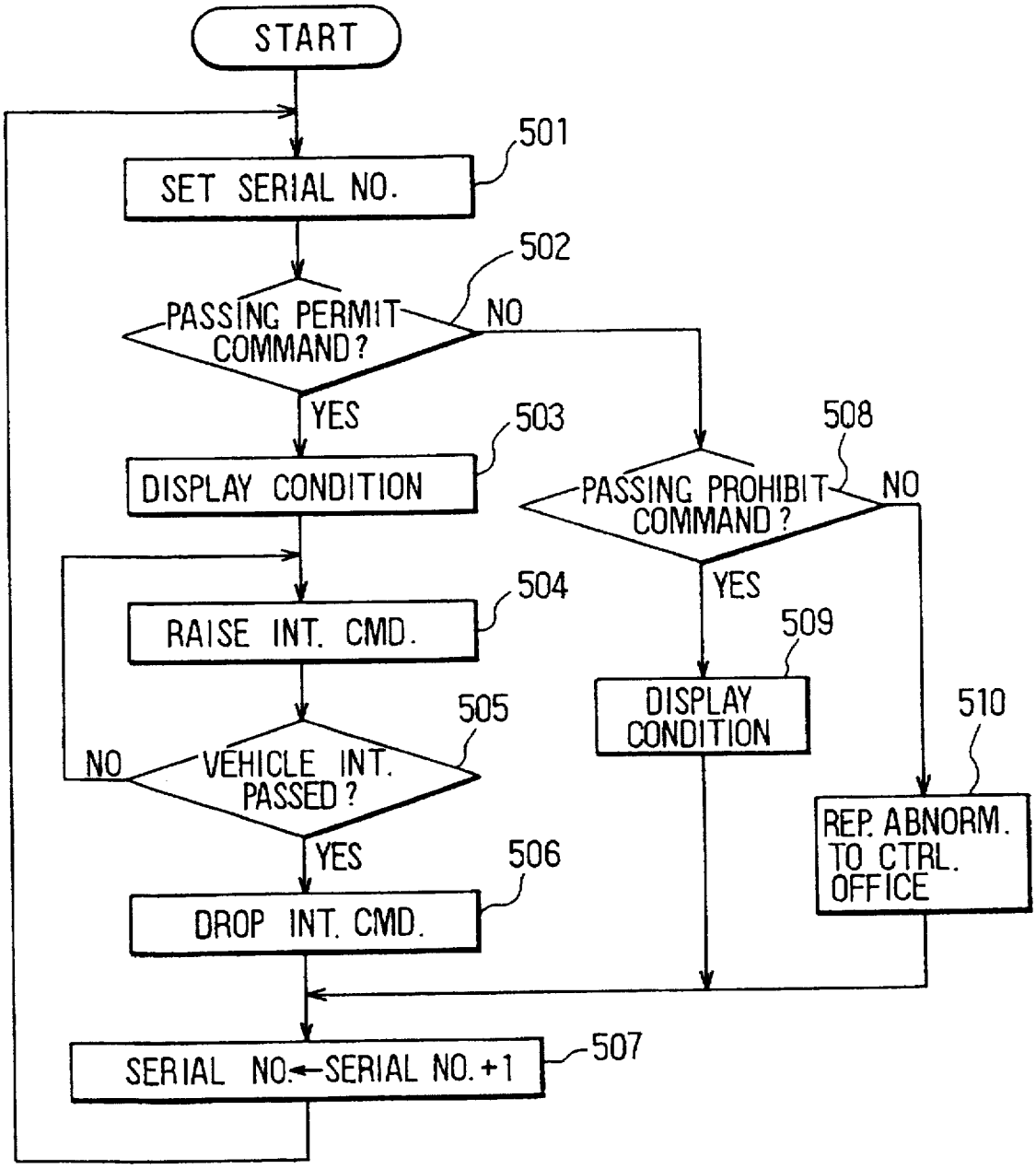
FIG. 8 is a flowchart of processing in the controller for a gate in the first embodiment.

When powering up the controller 50 for the gate 5, the routine of FIG. 8 will be executed. In Step 501, a serial number is set. This serial number is set by default when the routine of FIG. 8 runs for the first time to the same number set when the routine of FIG. 6 runs for the first time.

Step 502 determines whether the lane controller 80 has transferred the trespassing instruction for the currently set serial number. If the instruction has been transferred, Step 503 displays a message which notifies the driver that the vehicle may pass through, such as "Thank you" or "OK", on the indicator 6.

Step 504 opens the gate 5 to permit a vehicle to pass through, and Step 505 determines whether the vehicle has passed the gate 5 based on a signal from the foot plate 5a. These Steps 504 and 505 will be iteratively repeated until the vehicle is determined to have passed. When the vehicle is determined to have passed, Step 506 closes the gate 5, and Step 507 increments the serial number. Thereafter, processing returns to Step 501.

Conversely, if the passing instruction has not been transmitted by the lane controller 80 in Step 502, Step 508 determines whether a non-passing instruction for the currently set serial number is transferred from the lane controller 80. If the non-passing instruction is determined to have been transferred, processing proceeds to Step 509.

Step 509 displays a message which indicates that the vehicle may not pass through, such as "wait for a moment, please" or "NG", on the indicator 6, and processing proceeds to Step 507. Accordingly, the gate 5 is closed in this case.

If the result in Step 508 is NO, then the system reports the occurrence of an abnormal event to the administration office.

Figure 9:
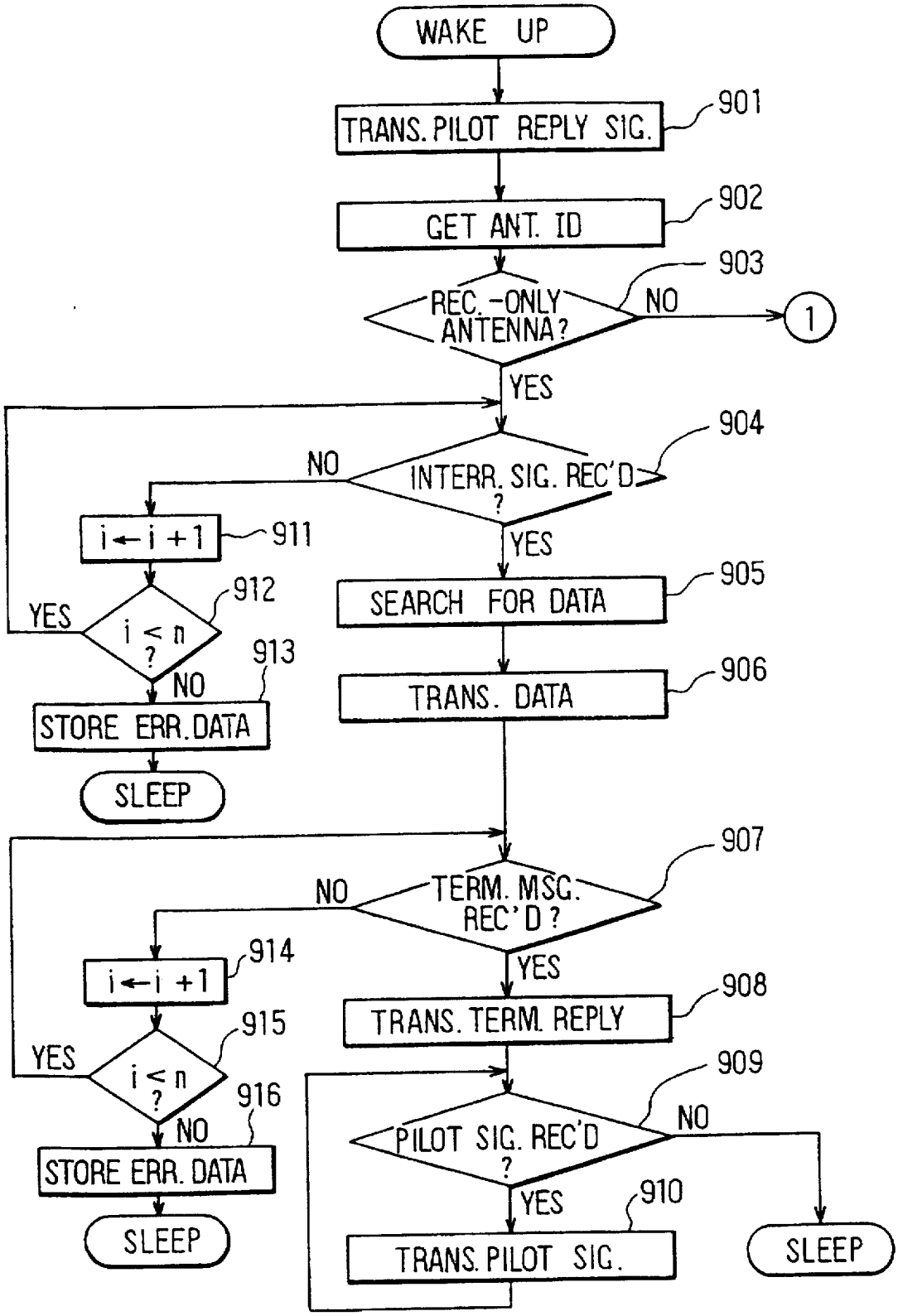
FIG. 9 is a flowchart of processing in respective vehicle-mounted devices in the first embodiment.

The processing of the CPU of the vehicle-mounted device will be described with reference to FIGS. 9 and 10.

The vehicle-mounted device wakes up when entering the communication area 3a or 4a, and in Step 901, it transmits a pilot response signal incorporating its own vehicle type data and ID therein. In Step 902, it retrieves ID incorporated in the currently receiving pilot signal.

Step 903 determines whether the currently received pilot signal is transmitted either from the reading antenna 3 or from the writing antenna 4, based on the ID retrieved in Step 902.

If the signal is transmitted from the reading antenna 3, Step 904 determines whether the request signal has been received from the reading antenna 3, and if so, Step 905 searches the RAM for the data required for the determination of the toll charge. Step 906 transmits this data to the RAM of the controller 30 for the writing antenna 4.

Step 907 determines whether the termination message is received from the reading antenna 3. If so, the termination response signal is transmitted in Step 908.

Thereafter, Step 909 determines whether a pilot signal from the reading antenna 3 is still being received. If so, the pilot response signal is transmitted in Step 910 and processing returns to Step 909. If the pilot signal is not still being received, the CPU goes to sleep. This means that if the vehicle-mounted device is within the communication area 3a after the process up to Step 908 has been performed, Steps 909 and 910 will be repeated iteratively, and if not, the vehicle-mounted device has left the communication area 3a and the CPU goes to sleep.

Alternatively, if the reading antenna 3 is not functioning properly, or a vehicle is running off the road 2, the request signal or termination message cannot be received. In this case, in Steps 911 and 914, i is incremented to determine whether it is greater than a predetermined number n in Step 912 and 915. If i is greater than n, it is determined that the request signal or termination message cannot be received as described above, error information is stored in the RAM, and the system goes to sleep.

Figure 10:
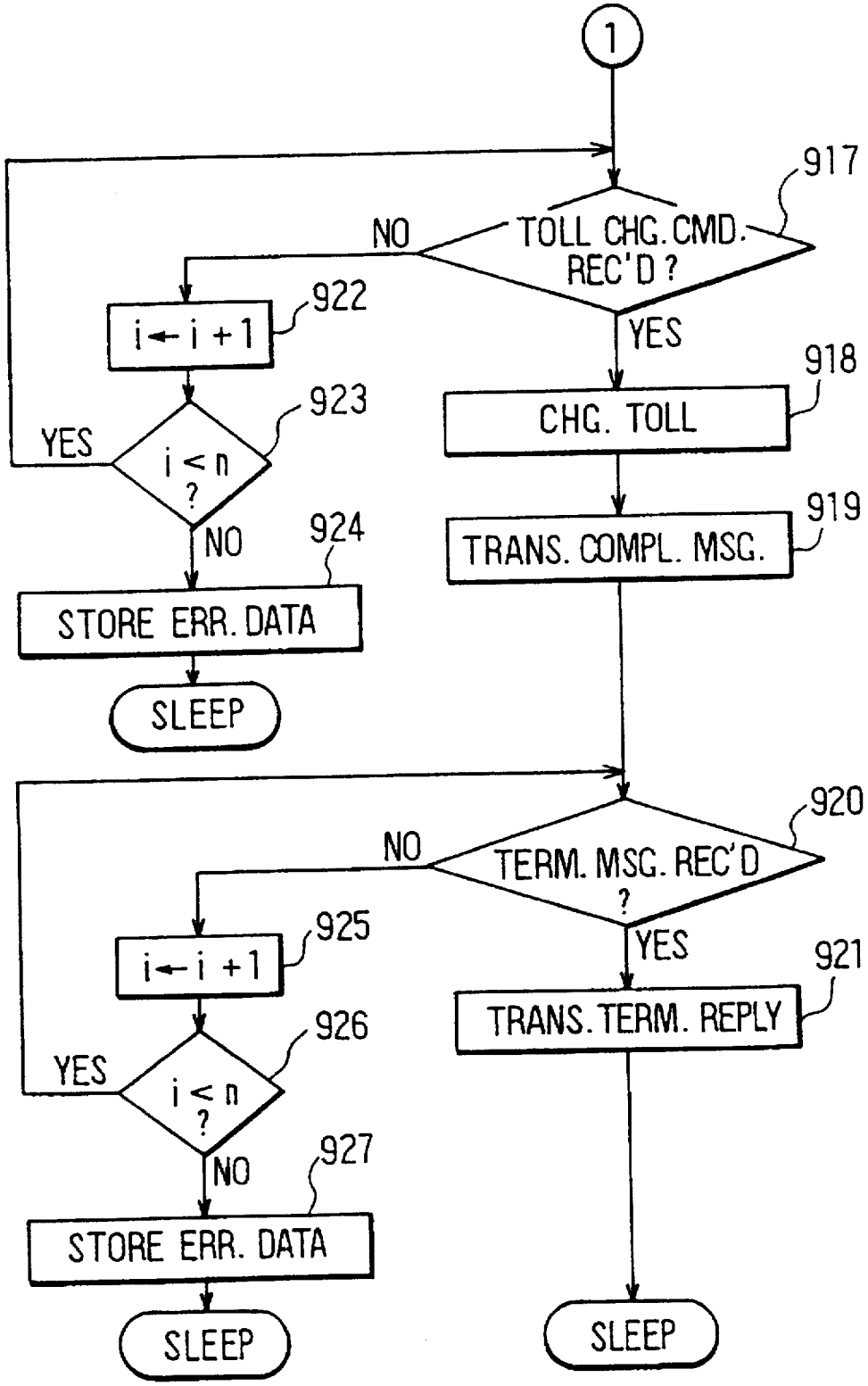
FIG. 10 is a flowchart of processing in respective vehicle-mounted devices in the first embodiment.

On the other hand, if Step 903 determines that the currently received pilot signal is transmitted from the writing antenna 4, Step 917 of FIG. 10, determines whether a toll charge writing instruction is received from the controller 40 for the writing antenna 4, and if so, then Step 918 writes that toll charge in the RAM of the vehicle-mounted device. Finally, Step 919 displays a termination message.

Step 920 determines whether the termination message (Step 408) is received from the writing antenna 4, and if so, then the termination response signal will be transmitted in Step 921. Thereafter, the CPU will go to sleep.

Also, if the writing antenna 4 is not functioning properly, or a vehicle is running off the road 2, the charge writing instruction or termination message cannot be received. In such a case, Steps 922–924 and Steps 925927 will be executed in a manner similar to Steps 911–913 and Steps 914–916 to put the CPU in sleep mode.

Next, an example of the processing in the respective controllers will be described below with reference to a case where vehicles pass through the vehicle type discriminator 1 in the order of a large-sized car, a motorcycle, and a medium-sized car.

When each of the large-sized car, motorcycle, and medium-sized car passes through the vehicle type discriminator 1 in that order, the controller 10 for the vehicle type discriminator will transfer type discrimination data to the lane controller 80 in the order of the large-sized car, the motorcycle, and the medium-sized car.

Thus, the large-sized car enters the communication area 3a at first. At that time, the controller 30 for the reading antenna 3 will transfer to the lane controller 80 data necessary for the determination of the toll charge, which has been transmitted from the device on the large-sized car. The controller 30 for the reading antenna 3 will continue to transmit the vehicle type data, ID, and entry time transmitted from the device on the large-sized car to the lane controller 80.

Subsequently, a motorcycle enters the communication area 3a. However, since the motorcycle will be hidden just behind the large-sized car, the controller 30 for the reading antenna 3 is not able to receive data necessary for the determination of the toll charge, vehicle type data, ID, and the entry time.

Further, a medium-sized car enters the communication area 3a. Since this medium-sized car is not concealed by the preceding car, the controller 30 for the reading antenna 3 receives data necessary for the determination of the charge from the device on that vehicle prior to the device on the motorcycle and transmits such data to the lane controller 80. Furthermore, the controller 30 for the reading antenna 3 will continue to transmit vehicle type data, ID, and the entry time from the device on the medium-sized car to the lane controller 80.

Since the communication area 3a of this embodiment has an exit side formed perpendicularly from the reading antenna 3 and underneath it, the order of vehicles exiting from the communication area 3a will be the large-sized car, the motorcycle, and the medium-sized car. The order that the vehicle type data, ID, and the time of that moment stop being transmitted to the lane controller 80 will also be in the order of the large-sized car, the motorcycle, and the medium-sized car.

The lane controller 80, on the other hand, performs the processing in Step 804 when the vehicle type data, ID, and the time of that moment stop being transmitted from the controller 30 for the reading antenna 3. In this embodiment, the lane controller 80 performs the processing in Step 804 in the order of a large-sized car, a motorcycle, and a medium-sized car.

Accordingly, unless there is a mismatch in a vehicle-mounted device, or any vehicle overtakes another one just ahead in the communication area 3a, the result of the determination in Step 804 is YES.

Here, if all of the vehicles satisfy these conditions so that the result of the determination in Step 804 is YES, when the large-sized car leaves the communication area 3a, a toll charge writing instruction which indicates that the charge should be written in the vehicle-mounted device is transmitted to the controller 40 for the writing antenna 4 together with the serial number set to, for example, 1, in Step 805, and a passing instruction which permits this large-sized car to pass through the gate 5 is transmitted to the controller 50 for the gate in Step 807.

Next, when the motorcycle or medium-sized car leaves the communication area 3a, a toll charge writing instruction which indicates that a toll charge is to be written in the device on the motorcycle or medium-sized car is transmitted to the controller 40 for the writing antenna 4 together with the serial number set to, for example, 2 (for the motorcycle) or 3 (for the medium-sized car) in Step 805, and a passing instruction which permits the motorcycle or medium-sized car to pass is transmitted to the controller 50 for the gate 5.

Thereafter, as soon as the large-sized car enters the communication area 4a formed by the writing antenna 4, the controller 40 for the writing antenna 4 receives the pilot response signal from the device on the large-sized car to perform the determination of Step 404. At this time, since the toll charge writing instruction for this large-sized car is already transferred to the controller 40 for the writing antenna 4 from the lane controller 80, Step 404 determines that a toll charge for the large-sized car should be written into the device on that large-sized car.

Thereafter, the motorcycle and the medium-sized car enter the area 4*a*. Since the motorcycle may be hidden just behind the large-sized car, the controller 40 for the writing antenna 4 receives the pilot response signal from the medium-sized car prior to the pilot response signal from the motorcycle. Then, the determination for this medium-sized car is performed in Step 404. At this time, since the charge writing instruction for this medium-sized car is already transferred to the controller 40 for the writing antenna 4 from the lane controller 80, Step 404 determines that the toll charge for the medium-sized car should be written into the device on that medium-sized car.

When the motorcycle appears from behind the large-sized car, the controller 40 for the writing antenna 4 receives the pilot response signal from the motorcycle device. The determination for this motorcycle is made in Step 404. At this time, since the charge writing instruction for this motorcycle is already transferred to the controller 40 for the writing antenna 4 from the lane controller 80, Step 404 determines that the toll charge for the motorcycle should be written into the motorcycle device.

These vehicles leaving the communication area 4*a* run toward the gate 5 sequentially, and the gate 5 permits all of them to pass through.

As can be seen from above description, in accordance with the present invention, the communication area 3*a* is formed approximately perpendicularly at the exit from the reading antenna 3 downwardly, and each vehicle-mounted device is mounted at a position where it may receive the pilot signal from the antenna above it. Also, in Step 804, the lane controller 80 compares the type discrimination data of vehicles passing through the vehicle type discriminator 1 in the order of vehicles passing therethrough with the vehicle type data in the order of vehicles leaving the communication area 3*a*.

In accordance with the present invention, even when a motorcycle is running just behind a large-sized car, if a vehicle-mounted device has no mismatches and if none of the vehicles overtakes another vehicle just ahead in the communication area 3*a*, the result of the determination in Step 804 is YES so that writing of the regular toll charge and the opening of the gate 5 may be performed. Also, if at least one of these two conditions is not satisfied, the result of the determination in Step 804 is NO so that writing of the charge to that vehicle is stopped, the gate is closed, and occurrence of an abnormality is reported to the administration office.

Additionally, when the controller 40 for the writing antenna 4 a pilot response signal from a vehicle-mounted device which enters the communication area 4*a*, it verifies the presence of the toll charge writing instruction to the device. If the instruction exists, the toll charge will be determined based on the data necessary for determining the charge transferred along with the instruction (such as issued site, issued date, information on the device on a vehicle), to write the charge into the vehicle-mounted device.

Accordingly, in the present embodiment, even when the order of vehicles in writing toll charges into the controller 40 of writing antenna 4 is different from the order of vehicles entering the communication area 4*a*, the proper charge may be written to each vehicle-mounted device.

A second preferred embodiment of the present invention will be described below.

Figure 11:
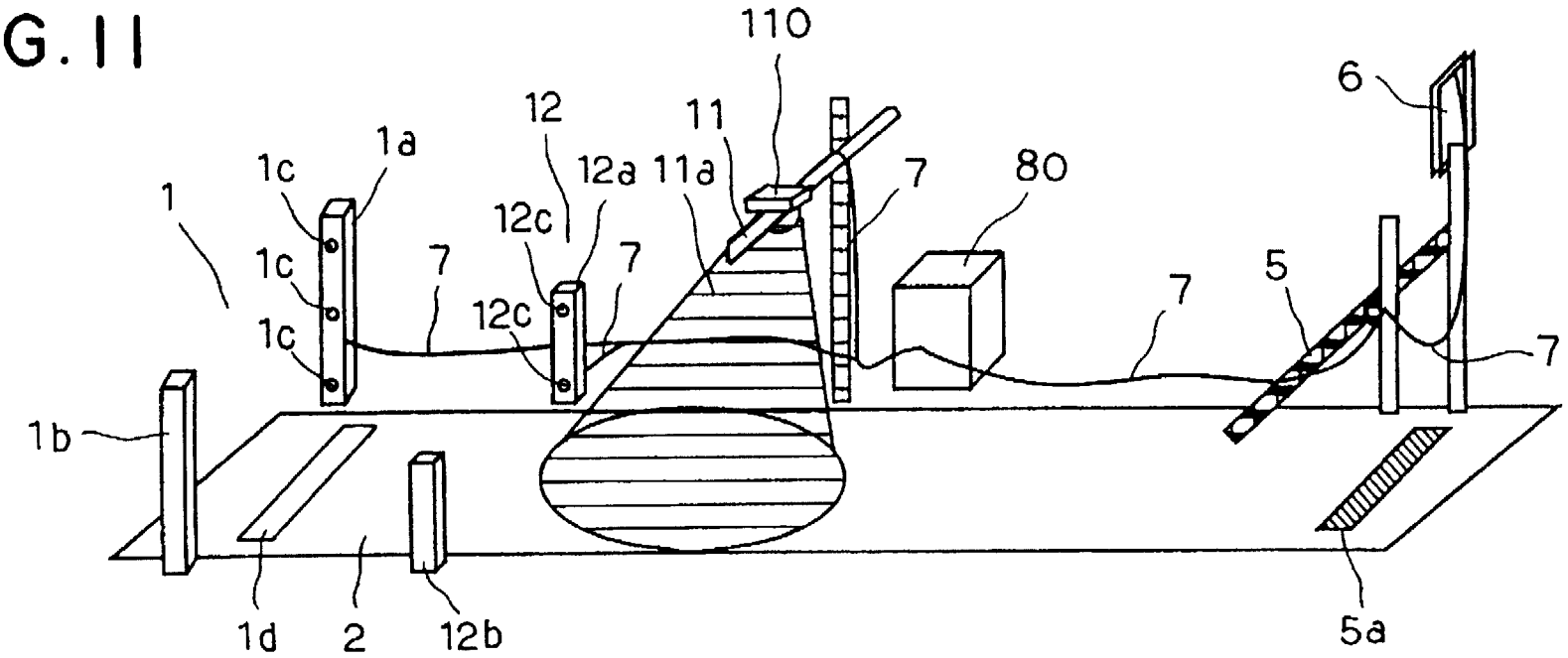
FIG. 11 is a schematic perspective view of a toll system according to a second embodiment of the present invention.

FIG. 11 schematically shows a road-side toll collection system according to the present invention. Reference numerals similar to those used in the previous embodiment designate similar elements, the description of which will be therefore be omitted for simplicity. Elements different from those in the first embodiment will be described hereinbelow.

In FIG. 11, a reference numeral 11 designates an antenna for reading and writing (hereinafter referred to as a R/W antenna) which is positioned over the road 2 at an elevation higher than vehicles passing therethrough. The R/W antenna 11 is connected to the controller 110 for R/Q antenna 11 and includes a microprocessor including an input/output interface, ROM, RAM, CPU, and so on. The controller 110 is connected to lane controller 80 through the communication link 7.

The CPU of the controller 110 periodically transmits a pilot signal and a carrier from the R/W antenna 11 in a range from the point beneath the antenna 11 to a predetermined distance from this point (e.g., the left hand side of FIG. 11), thereby forming a communication area 11*a* of the R/W antenna 11. The communication area 11*a* is formed ahead of the vehicle type discriminator 1 in the direction of vehicle travel (e.g., the right hand side of FIG. 11).

In FIG. 11, reference numeral 12 designates a car sensor for detecting that a vehicle is just going to enter the communication area 11*a*. The car sensor 12 includes a pair of posts 12*a* and 12*b* on opposite sides of the road 2, a plurality of light emitting elements 12*c* (preferably, infrared light emitting elements) provided on one of the posts 12*a*, and a plurality of photoreceptor elements (not shown) provided on the other post 12*b* at corresponding positions.

The paired column post members 12*a* and 12*b* are located so that a line connecting them is near the periphery of the communication area 11*a*. The light emitting elements 12*c* and photoreceptor elements are connected to the lane controller 80 through the communication link 7. The lane controller 80 senses when a photoreceptor element goes off to detect a vehicle passing through the car sensor 12, i.e., a vehicle entering the communication area 11*a* (see Step 825).

Figure 12:
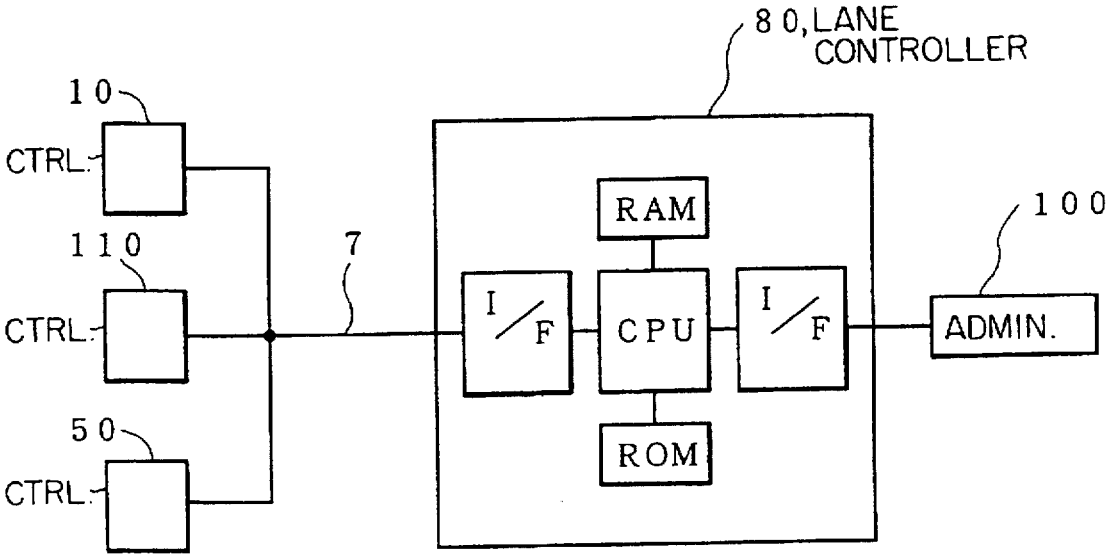
FIG. 12 is a block diagram of a control system in the second embodiment.

The interconnection between the controllers and microprocessors in the present embodiment is shown in FIG. 12.

The processing of the controllers and the vehicle-mounted devices will be described below. The processing of the controller 10 for the vehicle type discriminator 1 and the controller 50 for gate 5 in this embodiment is identical to that of the first embodiment, and the description thereof will be omitted.

The processing of the controller 110 for R/W antenna 11 will be described now in greater detail with reference to FIGS. 13 and 14.

Figure 13:
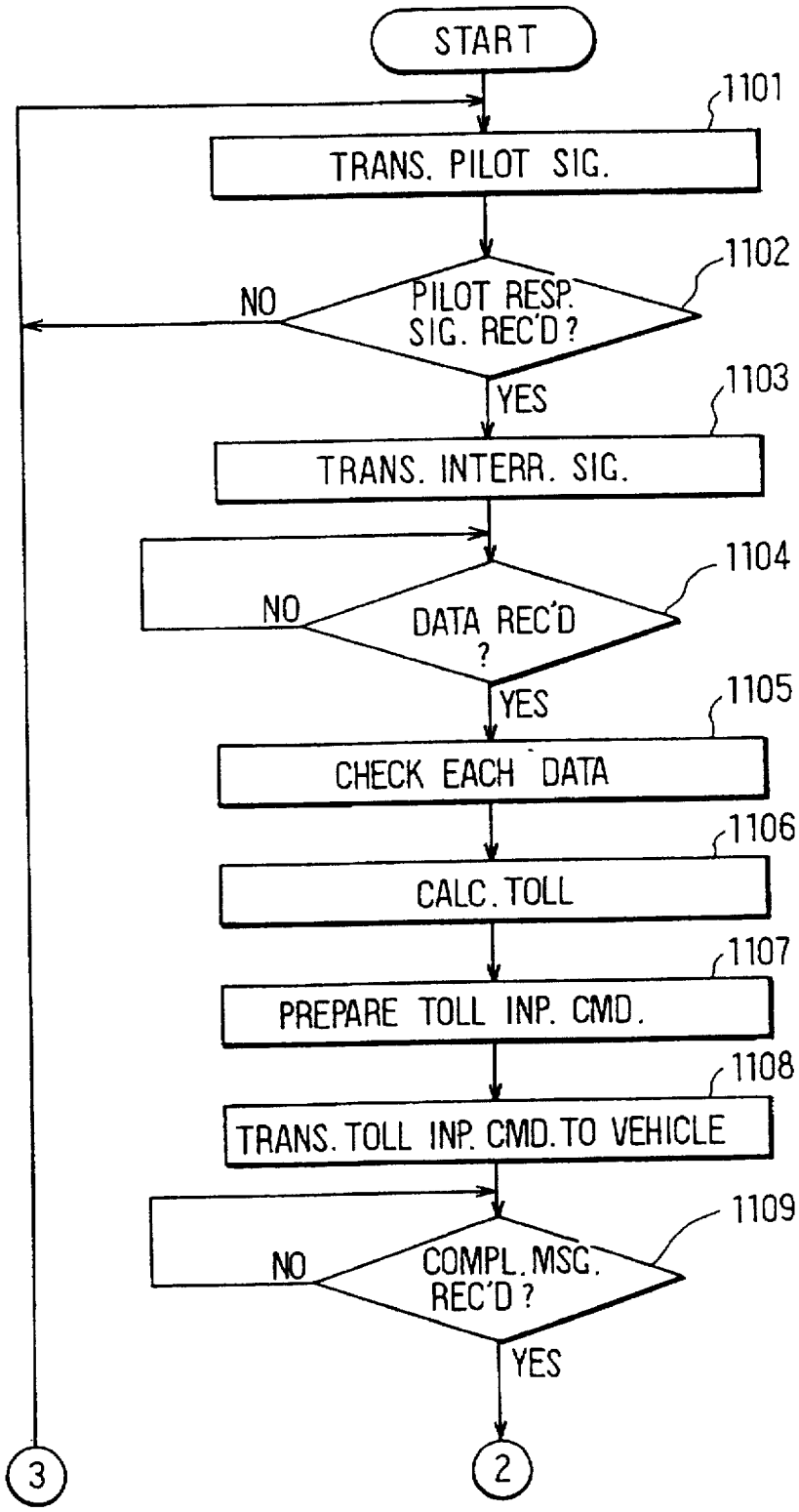
FIGS. 13 and 14 are a flowchart of processing in a controller for a reading/writing antenna in the second embodiment.
Figure 14:
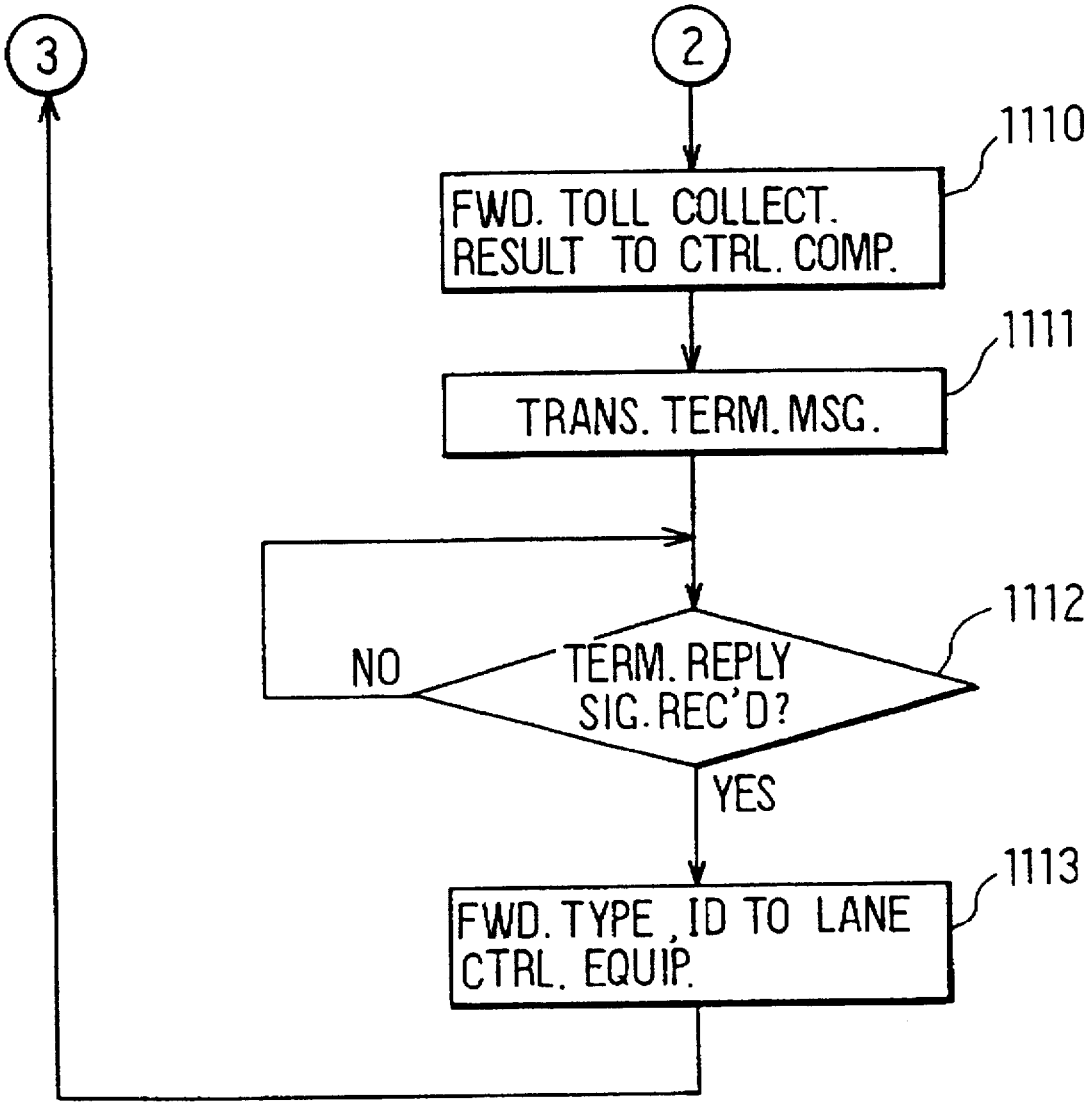

When powering up the controller 110 for the R/W antenna 11, the routine shown in FIGS. 13 and 14 is initiated. In Steps 1101 and 1102, the routine performs the same processing as in Steps 401 and 402 of the first embodiment. In Step 1101, the ID is incorporated in the transmitted pilot signal, which indicates that this pilot signal is sent from the R/W antenna 11.

If the result of the determination in Step 1102 is YES, the routine proceeds to Steps 1103 and 1104 to performprocessing similar to that of Steps 306 and 307 in the first embodiment. Step 1105 checks vehicle type data transmitted from the vehicle-mounted device, its ID, and data necessary for the determination of the charge. In Step 1106, the toll charge is determined based on the data necessary for the determination of the charge, and in Step 1107, the toll charge writing instruction is prepared for writing the determined charge into the device on a vehicle.

In Steps 1108 to 1112, processing similar to that of the first embodiment is performed. Step 1113 transfers the vehicle type data and ID transmitted from the vehicle-mounted device to the RAM of the lane controller 80. This step is performed to count the number of the devices which terminated data communication with the controller 110 for the R/W antenna in Step 829 described below.

Figure 16:
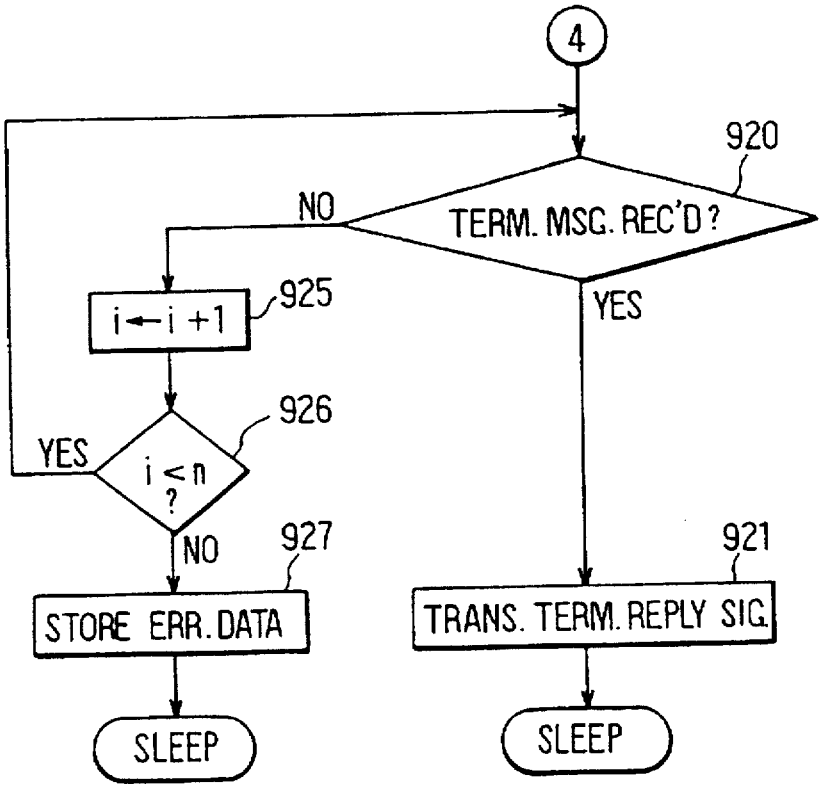
FIGS. 15 and 16 are a flowchart of processing of respective vehicle-mounted devices in the second embodiment.
Figure 15:
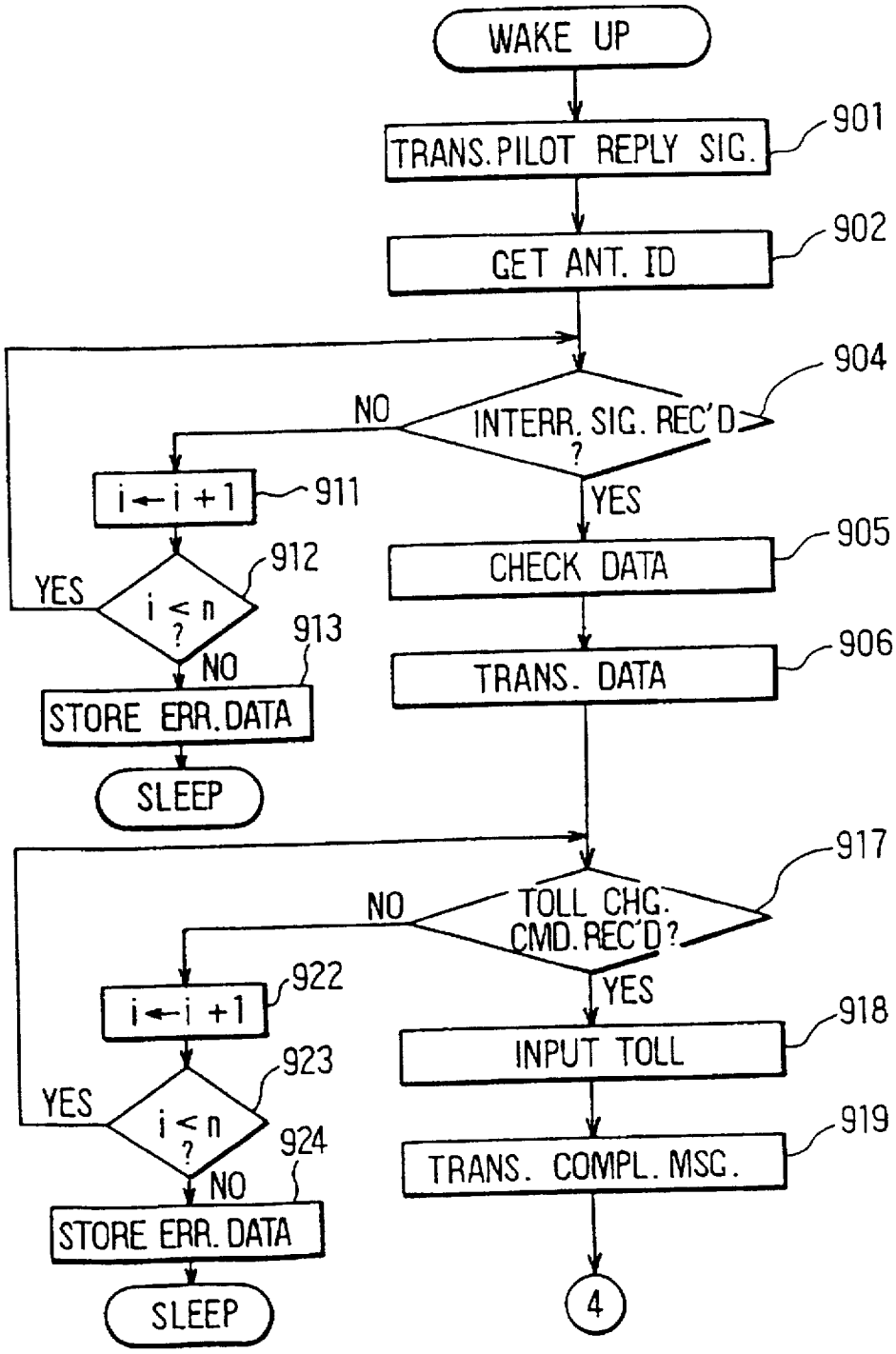

The processing of the vehicle-mounted device will be described with reference to FIGS. 15 and 16. The same processing as that of the vehicle-mounted device described in the first embodiment is designated with similar numerals, and a description thereof will be omitted.

The vehicle-mounted device wakes up when entering in the communication area 11*a*, and performs Steps 901 and 902. When finishing the processing of Step 902, Steps 904 to 906, and 911 to 913 are performed. Also Steps 917 to 927 are performed after Step 906.

The processing of the lane controller 80 will now be described with reference to FIGS. 17 to 19.

Figure 18:
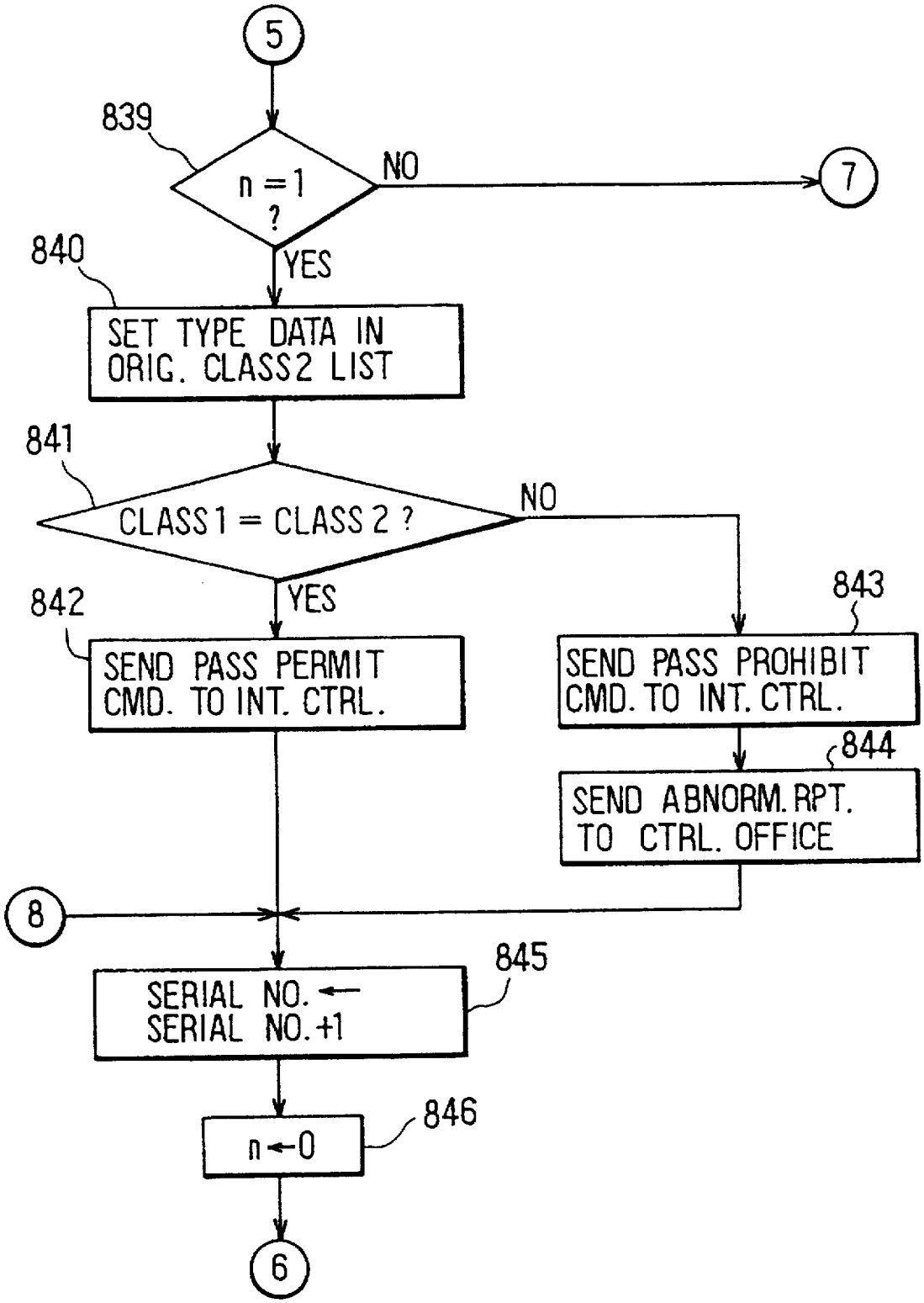
Figure 19:
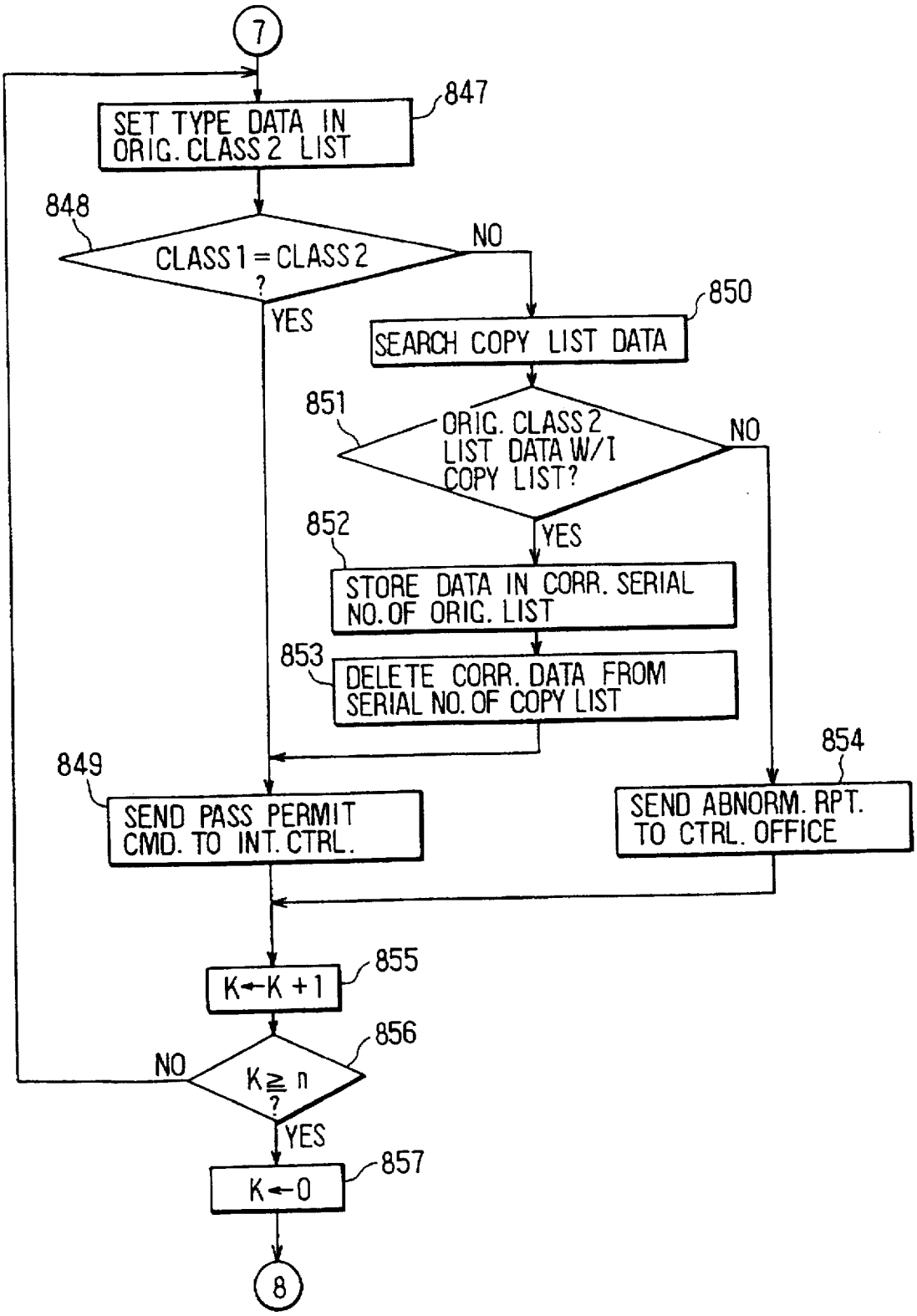

When powering up the lane controller 80, the routine shown in FIGS. 17 to 19 is initiated. In Step 821, i is cleared. Step 822 makes a determination similar to that of Step 802 in the first embodiment. If the result of the determination is YES, a vehicle has passed through the vehicle type discriminator 1, and a serial number is set in Step 823. This serial number is set to a predetermined number (for example, 1) by default when the routine of FIGS. 17 to 19 is executed for the first time.

Step 824 stores the type discrimination data transferred from the controller 10 for the vehicle type discriminator 1 in the primary list class1 of the currently set serial number. The primary list is composed of part of the RAM of the lane controller 80, which is structured as shown in FIG. 20A to include a partition class1 for storing type discrimination data and another partition class2 for storing the vehicle type data.

Step 825 determines whether and which of the photoreceptors on the post 12*b* turns off, and thereby determines whether a vehicle has passed through the car sensor 12. This Step 825 will be repeated until a vehicle passes through the car sensor 12.

If a vehicle passes through the car sensor 12, it indicates that the vehicle is entering the communication area 11*a*. The routine then proceeds to Step 825A to determine whether any data is stored in the secondary list described below. If no data is stored in the secondary list, Step 825B sets the expiration of a timer to be counted in Steps 826 to 828 to $\alpha$. Conversely, if some data is stored in the secondary list, Step 825C sets the expiration of the timer to be $2\times\alpha$, and the timer is started in Step 826. Step 827 waits until the duration since the initiation of the timer, TIMER, will have exceeded a predetermined expiration period of time $\alpha$ ($2\times\alpha$); when the predetermined period of time $\alpha$ ($2\times\alpha$) elapses, the timer will stop in Step 827.

Step 829 counts the number of vehicle-mounted devices n which have terminated data communications with the controller 110 for the R/W antenna. More specifically, the vehicle type data and ID stored in the RAM after being transferred from the controller 110 for the R/W antenna 11 corresponding to the number of the vehicle-mounted devices is counted.

Accordingly, when performing Step 829 prior to Steps 826 to 828, the number n will be counted in Step 829 until the elapsed time TIMER exceeds a predetermined period of time $\alpha$ ($2\times\alpha$).

As can be seen from the description above, the predetermined period of time $\alpha$ in the present embodiment is set to duration such that a vehicle-mounted device which may perform data communications with the controller 110 for reading/writing since when entering the communication area 11*a* may perform data communications with the controller 110 for the R/W antenna 11. It should be noted that the predetermined expiration time $2\times\alpha$means the twice the predetermined expiration time $\alpha$.

On the other hand, if the type discrimination data is not transferred in Step 822, i is incremented in Step 830 to determine whether it is less than a predetermined number m in Step 831.

In Step 831, if i is equal to m, the routine returns to Step 822. If not, by determining whether any data is stored in secondary list, this step determines whether there are any vehicles which have not yet terminated data communications with the controller 110 for the R/W antenna within the communication area 11*a*.

The secondary list here is a list composed of part of the RAM of the lane controller 80, which, as shown in FIG. 20(*b*), has an area for storing serial numbers, another area for storing type discrimination data class1 and still another area for storing vehicle type data class2. Also this secondary list includes storage means as defined in the appended claims.

If there is no data in the secondary list, that is, if there is no vehicle which is still communicating within the communication area 11*a*, Step 832 causes processing to return to Step 822. If it is determined that there is some data, i.e., that there are some vehicles as above, the serial number is decremented in Step 833.

In Step 834, this serial number is set, and in Step 835, for the serial number set in Step 834, the type discrimination data stored in the secondary list class1 of the same serial number is stored in the primary list class1. The routine then returns to Step 829.

After the processing in Step 829, Step 836 determines whether there is any vehicle-mounted device which terminated data communications with the controller 110 for the R/W antenna 11 by determining if $n>0$. Examples of the cases where the result of the determination is NO include, for example, the case where there is a vehicle which has not yet terminated data communications with the controller 110 for the R/W antenna 11 after entering in the communication area 11*a*.

In such a case, Step 837 stores the currently set serial number in the area for storing the serial number of the secondary list, together with the type discrimination data stored in the primary list class1 of that serial number being stored in the secondary list class1, and the secondary list class2 will be left blank. Then, the serial number is incremented in Step 838 and processing returns to Step 821.

As can be seen, storing the type discrimination data in the secondary list class1 is for storing the fact that the device on the vehicle stored in the secondary list is hidden by another vehicle just ahead of it; thus, the data communication could not yet terminate with the controller 110 for the R/W antenna 11 from the start of the timer to the expiration of the predetermined time duration $\alpha$.

On the other hand, if the result of the determination in Step 836 is YES, this means that there at least one vehicle-mounted device which has terminated data communication with the controller 110 for the R/W antenna 11 until the predetermined duration α has expired since the timer started. Then, Step 839 determines whether there is only one such device.

Here, for example, the result of the determination in Step 839 is YES because only the device on a large-sized car may terminate the data communications within the predetermined duration of time α unless another large-sized car, which blocks data communications between the device on the former with the controller 110 for the R/W antenna 11.

If the result of the determination in Step 839 is YES, Step 840 stores the vehicle type data transferred from the controller 110 for the R/W antenna 11 in the primary list class2 for the currently set serial number.

In Step 841, for the currently set serial number, the type discrimination data of class1 and the vehicle type data of class2 are compared. If there is no difference, this indicates that the device on that vehicle has no mismatch, and this vehicle did not overtake another one just ahead; therefore, processing similar to that of Step 807 in the first embodiment is performed in Step 842.

On the contrary, if the result of the determination in Step 841 is NO, indicating that either the device on this vehicle has a mismatch, or this vehicle did overtake another one running just ahead of it in the communication area 11*a*, in Steps 843 and 844, processing similar to that in Steps 810 and 811 will be performed.

Further in Step 845, the serial number is incremented, and in Step 846, the number n counted in Step 829 is cleared, and processing returns to the Step 821.

If the result of the determination in Step 839 is NO, it indicates that there is a case where, for example, a large-sized car, a motorcycle, and a medium-sized car pass through the car sensor 12 in that order, the third, i.e., the medium-sized car having passed the car sensor 12, triggers the timer and terminates data communication with the controller 110 for the R/W antenna 11 before the predetermined expiration α (2×α), as well as before the same predetermined expiration α (2×α), the second motorcycle appears from behind the first large-sized car so that the device on this motorcycle terminates data communication with the controller 110 for the R/W antenna 11.

In such a case, the processing of Steps 847 to 854 will be repeated n times. More specifically, in Step 847, the first vehicle type data transferred from the controller 110 for reading/writing is stored in the primary list class2 for the currently set serial number.

Then, Step 848 determines whether the type discrimination data in class1 for this serial number is equal to the vehicle discrimination data in class2. If equal, this indicates that the device on this vehicle has no mismatch and this vehicle did not overtake another vehicle just ahead of it, so in Step 849, processing similar to that of Step 842 will be performed.

In Step 855, k is incremented. Step 856 determines whether k is greater than n. That is, Step 856 determines whether Steps 847 to 854 have been repeated n times. If not, the routine returns to Step 847. If k is greater than n (i.e., the steps have been repeated n times), k is cleared in Step 857 and the routine returns to Step 845. The variable k is set to 0 by default when initiating the routine of FIGS. 17 to 19 for the first time.

If the result of the determination in Step 848 is NO, data in the secondary list will be searched in Step 850. Step 851 determines whether the same type discrimination data as the vehicle type data stored in the primary list class2 for the currently set serial number is stored in the secondary list based on the result of the search in Step 850.

If the same type discrimination data is stored therein, the device on this vehicle has no mismatch and it did not overtake another vehicle just ahead of it in the communication area 11*a*; therefore, in Step 852, this type discrimination data is stored in the primary list class2 for the same serial number as the serial number in the secondary list in which this type discrimination data is stored. In Step 853 the data in the secondary list for this serial number is deleted, and the routine proceeds to Step 849.

If the determination result in Step 851 is NO, either the device on this vehicle has a mismatch or it did overtake another vehicle just ahead of it in the communication area 11*a*; therefore, processing similar to that of Step 844 is performed in Step 854, and the routine proceeds to Step 855.

Next, with reference to FIGS. 21 and 22, the processing in the controllers will be described below by means of an example where a large-sized car, a motorcycle, and a medium-sized car pass through the vehicle type discriminator 1.

Figures 21A, 21B:
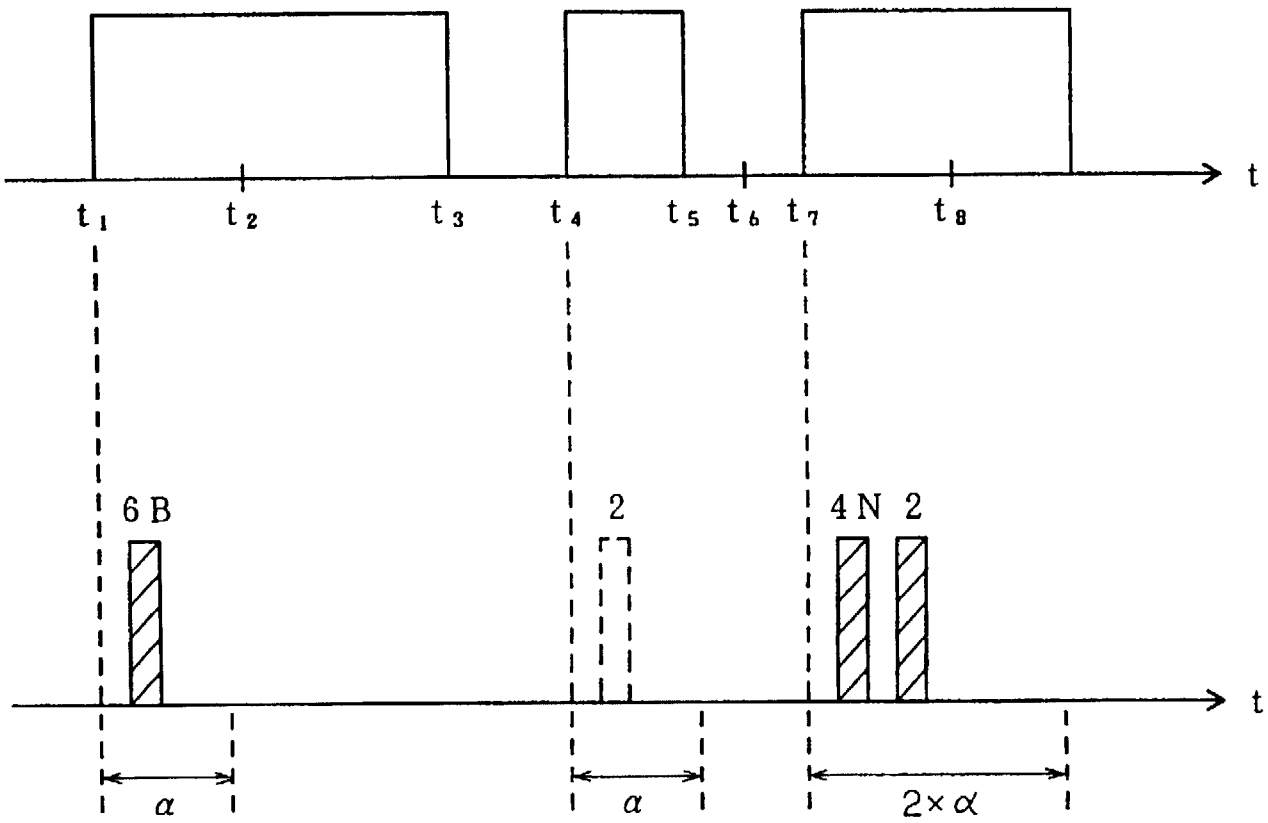
FIGS. 21A and 21B respectively are a timing chart indicating an aspect of a vehicle at a car sensor, and a timing chart indicating an aspect of terminated data communication between a vehicle-mounted device and the controller in this embodiment.

FIG. 21A is a timing chart showing how respective vehicles pass through the car sensor 12, and FIG. 21B is a timing chart showing how respective vehicles terminate data communication with the controller 110 for the R/W antenna 11.

When a large-sized car, a motorcycle, and a medium-sized car pass through the vehicle type discriminator 1 in that order, the controller 10 for the vehicle type discriminator 1 transfers the type discrimination data to the lane controller 80 in the order of a large-sized car, a motorcycle, and a medium-sized car.

Thereafter, the large-sized car at first starts passing the car sensor 12 at the time t1 in FIG. 21A. After t1, the timer is activated for the predetermined expiration period α. In this situation, there is no large-sized car which blocks data communications between the device on this large-sized car and the controller 110 for the R/W antenna 11, so the device on this large-sized car may terminate data communication before expiration of the predetermined duration α.

In this case, there is only one device which terminates data communication from t1 to the predetermined expiration period α. For t2, just after the predetermined expiration period α, Step 839 yields a result of YES.

At time t2, according to the processing in Step 824, type discrimination data 6B for the large-sized car shown in FIG. 22A is stored in the primary list class1 for a given serial number (for example, 1). At this time, if the device on this large-sized car has no mismatch and it did not overtake another vehicle within the communication area 11*a*, the vehicle type data 6B as shown in FIG. 22A is stored in the primary list class2 for the serial number 1.

Accordingly, in this case, the result of the determination in Step 841 is YES, and in Step 842 a passing instruction for the serial number 1 is transferred to the controller 50 for the gate 5.

It should be noted that in this case, Step 837 will be skipped, so no data is stored in the secondary list, as shown in FIG. 22B.

Next, at time t3 in FIG. 21A, the large-sized car has passed the car sensor 12, and at time t4, the subsequent motorcycle starts passing through the car sensor 12. From this time, the timer is activated for a predetermined expiration period. At this time, the device on the motorcycle, which should have terminated data communications before the expiration period α, is actually not able to terminate communications since this motorcycle is hidden just behind the large-sized car ahead.

In this case, there is no device which terminates data communications from time t4 for the predetermined expiration α. At time t6 just after the predetermined expiration period α, the result of the determination in Step 836 is NO.

Accordingly, as shown in FIG. 23A, type discrimination data 2 for the motorcycle is stored in the primary list class1 for the serial number 2; however the class2 will be left blank. Further, as shown in FIG. 23B, the currently set serial number 2 is stored in the secondary list, and the type discrimination data 2 for the motorcycle is stored in the class1 for that serial number. Class2 will be left blank.

Next, at time t5 of FIG. 21, the motorcycle has passed through the car sensor 12, and at time t7, the subsequent medium-sized car starts passing through the car sensor 12. At this time, the timer is activated for the predetermined expiration period α (2×α). At this time, there is no large-sized car which may block data communications between the device on this medium-sized car and the controller 110 for the reading/writing antenna, so the device on this medium-sized car may terminate data communications before the expiration period α (2×α).

As shown in FIG. 21B, for the same predetermined expiration α period (2×α), the motorcycle which could not perform data communications because it was hidden just behind the large-sized car might terminate data communications after appearing from behind the large-sized car.

In this case, at time t8 just after the predetermined expiration period α (2×α), for example, type discrimination data 4N for the medium-sized car is stored in the primary list class1 for the serial number 3 as shown in FIG. 24A by Step 824. Furthermore, the result of the determination in Step 839 is NO so that Step 847 is performed.

In this case, if the device on this medium-sized car has no mismatch, and the medium-sized car did not overtake another vehicle just ahead of it in the communication area 11*a*, the vehicle type data 4N for this medium-sized car is stored in the primary list class2 for the serial number 3 as shown in FIG. 24A.

Thus, in this case, the result of the determination in Step 848 is YES, so that in Step 849, a passing instruction for the serial number 3 will be transferred to the controller 50 for the gate 5. Then, Steps 855 and 856 will be repeated once, and Step 847 also will be performed again.

In Step 847, as shown in FIG. 25A, vehicle type data 2 for the motorcycle is stored in the primary list class2 for the serial number reading antenna 3. Here, since the type discrimination data 4N for the medium-sized car is already stored in the primary list class1 for the serial number 3, the result of the determination in Step 848 is NO.

As shown in FIG. 25B, since in the secondary list, the type discrimination data (2) which is the same as the type discrimination data (2) stored in the primary list class2 for the serial number reading antenna 3 is already stored, the result of the determination in Step 851 is YES.

In Step 852, as shown in FIG. 26A, this type discrimination data (2) is stored in the primary list class2 for the serial number 2. Then in Step 853, the data in the secondary list is deleted as shown in FIG. 26B, and in Step 849, the passing instruction for the serial number road 2 is transferred to the controller 50 for the gate 5.

As have been described above, in the present embodiment, if there is no mismatch in the devices on respective vehicles, and no vehicle overtook a previous vehicle running ahead of it, the passing instructions for respective vehicles are issued to the controller 50 for the gate 5 (e.g., even when a motorcycle is running just behind a large-sized car) to open the gate 5 for the respective vehicles.

On the other hand, if any vehicle has either an improper device, or did overtake another vehicle running just ahead of it within the communication area 11*a*, the result of the determination in Step 841 or 851 is NO. Therefore, the gate 5 may be closed or the occurrence of an abnormality for that vehicle may be reported to the administration office.

Next, a third preferred embodiment of the present invention will be described below.

Figure 27:
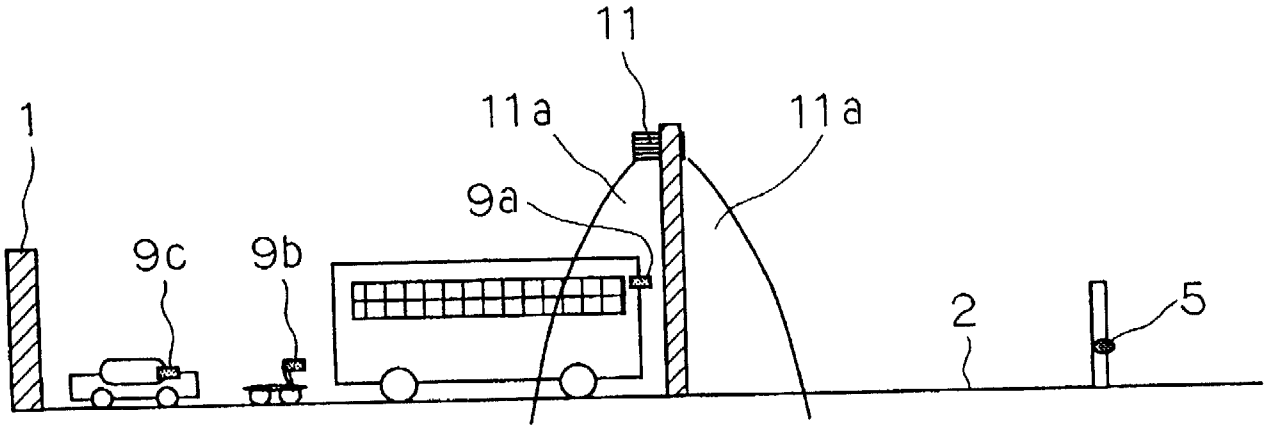
FIG. 27 is a schematic side view of a toll system according to a third embodiment of the present invention.

FIG. 27 schematically shows the toll system according to this embodiment. Here, elements similar to those in the first or second embodiments are designated with similar numerals, and description of those elements will be omitted.

A R/W antenna 11 in this embodiment is directed to generally below it; thereby, a communication area 11*a* is formed downwardly from the antenna 11 and approximately perpendicular to the direction of travel of vehicles therethrough.

The antennas for the devices on respective vehicles 9*a*–9*c* are provided at positions where pilot signals from the antenna 11 for reading/writing may be received (e.g., at a position outside the cabin; for example, on the roof of the vehicle).

The processing of the respective controllers and vehicle-mounted devices will be described below. The operation of the controller 20 for the vehicle type discriminator 1, the controller 50 for the gate 5, the controller 110 for the R/W antenna 11, and the vehicle-mounted devices in this embodiment are similar to corresponding elements in the second embodiment, and description thereof will be omitted.

Figure 28:
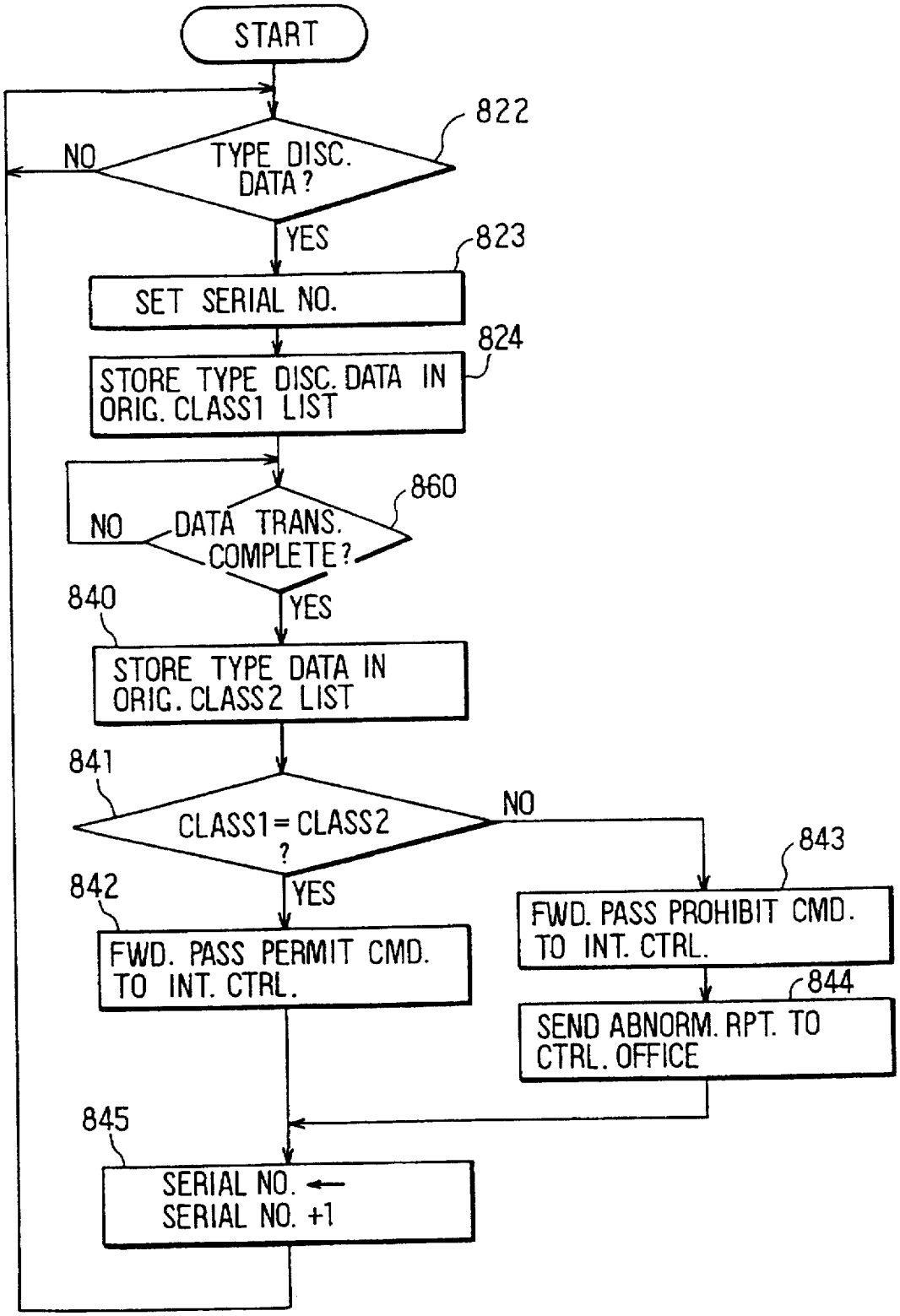
FIG. 28 is a flowchart of processing in a lane controller in the third embodiment.

The operation of the lane controller 80 will be described with reference to FIG. 28. In FIG. 28, the parts performing operations similar to corresponding parts in the lane controller 80 in the second embodiment are designated with similar numerals, and the description thereof will be omitted.

When powering up the lane controller 80, the routine shown in FIG. 28 will be initiated. The determination in Step 822 will be performed and repeated until its result is YES. If the determination result is YES, Steps 823 and 824 are performed.

In Step 860, it is determined whether the data communication between the device on that vehicle and the controller 110 for reading/writing antenna has been terminated, by determining whether vehicle type data and ID have been transferred from the controller 110 (Step 1113). This determination will be iteratively repeated until termination will have been determined. If the termination is detected, Steps 840 to 845 are performed. Thereafter, the routine returns to Step 822.

In this embodiment, the secondary list in the second embodiment is not used.

As can be seen, according to the present embodiment, since the R/W antenna 11 is located to form the communication area 11*a* therebelow, even when a motorcycle is running just behind a large-sized car, the device on the motorcycle may immediately perform data communications with the controller 110 for the R/W antenna 11 when entering into the communication area 11*a*.

If there is no mismatch in the vehicle-mounted devices and no vehicle overtook another vehicle running just ahead of it in the communication area 11*a*, the order that each vehicle passes through the vehicle type discriminator 1 will be identical to the order that each vehicle terminates data communication with the controller 110 for the R/W antenna 11. By confirming whether both orders are identical, any mismatch in the device on a vehicle or any overtaking in the communication area 11*a* can be detected.

Figure 29:
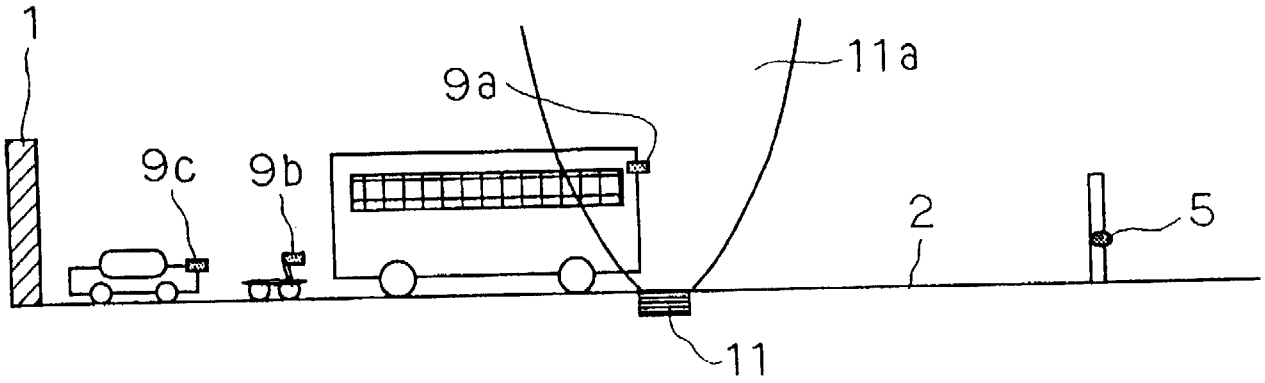
FIG. 29 is a schematic side view of a toll system according to a modification of the third embodiment.

In the third embodiment described above, the R/W antenna 11 is provided over the road 2 and at a height higher than the vehicles so that the communication area 11*a* is formed downwardly from this point. However, as shown in FIG. 29, the R/W antenna 11 may be located on the road 2 to form a communication area 11*a* roughly upwardly from that point. In this case it is sufficient to change the position of the mounted antennas of respective vehicle-mounted devices to allow pilot signals emanating from below to be received.

Figure 30:
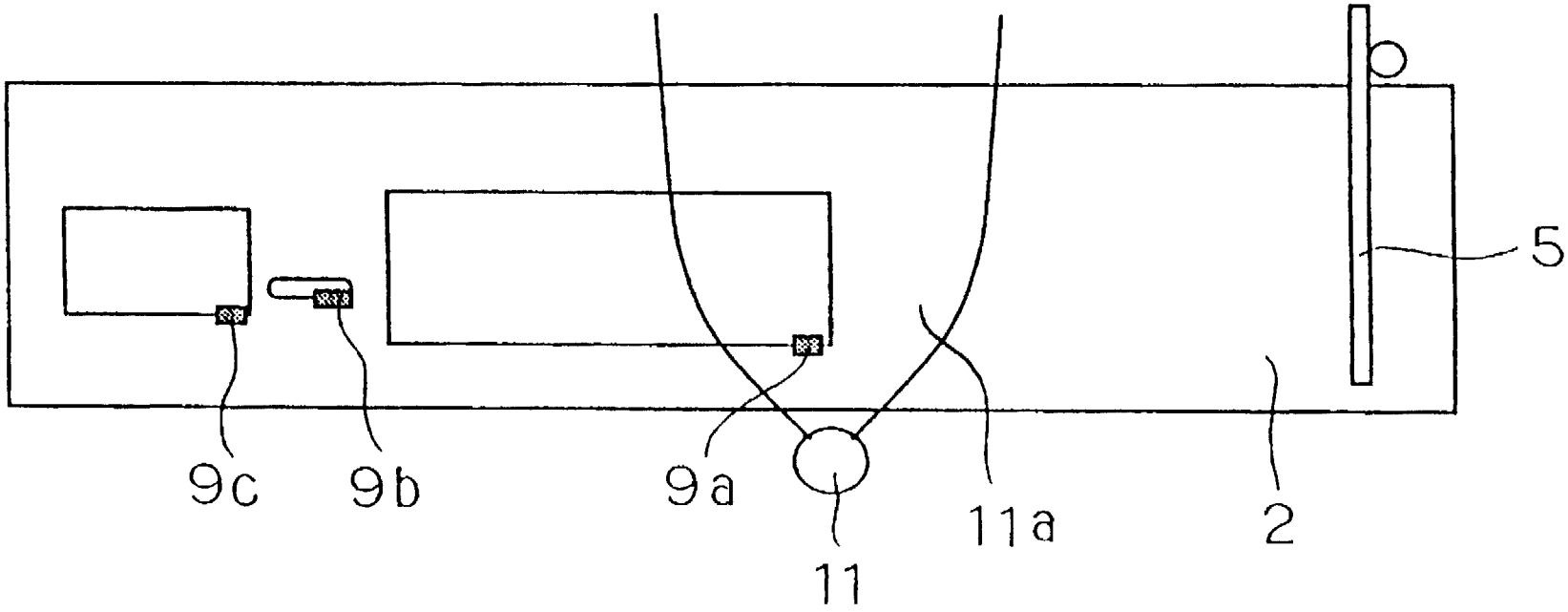
FIG. 30 is a schematic top view of the toll system according to the modification.

As shown in FIG. 30, the antenna 11 may be provided on the side of the road 2 to form the communication area 11*a* generally laterally from that location. In this case, it is sufficient to change the position of the antennas of respective vehicle-mounted devices to allow pilot signals to be received from a lateral direction.

In the first embodiment, the vehicle type discriminator 1 is provided in front of the reading antenna 3 in the direction of vehicle travel; however, the order may be reversed. The important point is to determine whether the order of the vehicles passing through the vehicle type discriminator 1 is the same as the order of the vehicles passing through the communication area 3*a*, thereby detecting vehicle-mounted device mismatches and overtaking by a vehicle of another vehicle running just ahead of it in the communication area 3*a*.

In the embodiments described above, the antennas 3, 4, and 11 transmitting pilot signals have been described, where once the pilot signal is received by the vehicle-mounted device, the vehicle-mounted device responds with a pilot response signal to the antenna. These antennas 3, 4, and 11 need not transmit a pilot signal if the device on a vehicle continuously transmits a pilot response signal.

Figure 31:
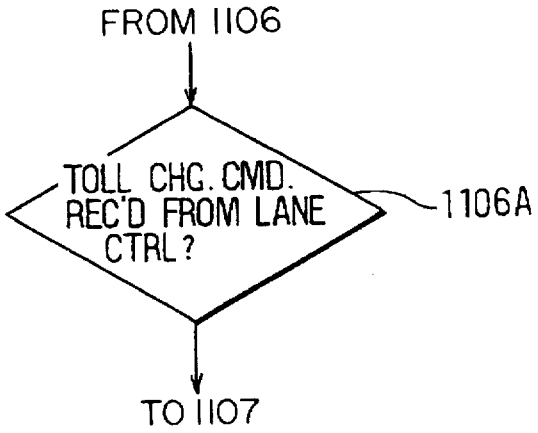
Figure 32:
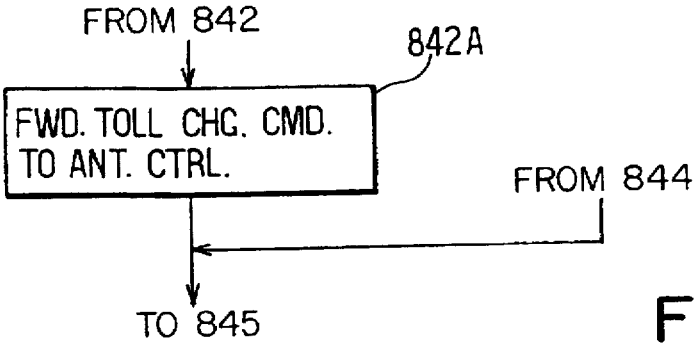
Figure 33:
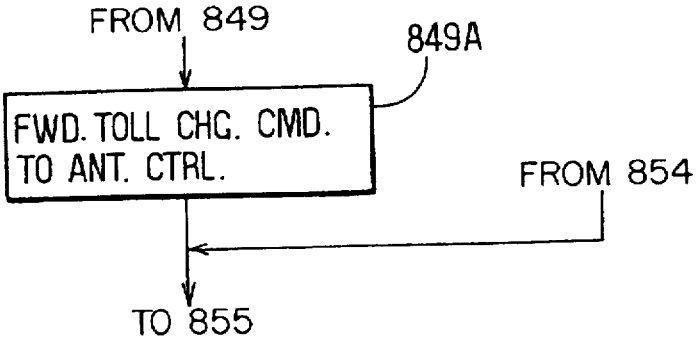

In the second embodiment described above, class1 is compared with class2 after having terminated toll charge writing for the vehicle-mounted device. However, it may be possible that the toll charge writing is performed only responsive to the result of the comparison of class1 with class2. In this case, Step 1106A shown in FIG. 31 is to be inserted between Step 1106 and Step 1107 of FIG. 13, Step 842A shown in FIG. 32 is to be inserted between Step 842 and Step 845 of FIG. 18, and Step 849A shown in FIG. 33 is to be inserted between Step 849 and Step 855. In addition, Step 826 of FIG. 17 (i.e., count the number of data from the antenna controller) is to be replaced with an appropriate step (i.e., count the number of devices transmitting a pilot response signal from the antenna controller).

In the above embodiments, although photodetectors and weight sensors are used in the vehicle type discriminator, the discriminator may use an image recognition device such as a CCD camera instead.

Further, in the above embodiments, although the communication area is formed downstream of the vehicle type discriminator, the area may be formed upstream of the discriminator instead.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A toll system comprising:

a vehicle type discriminator for discriminating a type of running vehicles and producing vehicle type discrimination data based thereon;

communication means located at a position above a road, for forming a communication area downwardly therefrom and in the direction of an upstream side of said road, and for communicating with devices provided on vehicles in said communication area;

determining means for determining whether or not an order of said vehicles passing through said vehicle type discriminator matches an order of said vehicles passing through said communication area by comparing said vehicle type discrimination data with vehicle type data transmitted from said devices provided on said vehicles to said communication means; and verifying means for verifying that proper communication is made between said communication means and a device on a vehicle passing through said communicating area based on said determination of said determining means.

2. The toll system of claim 1, further comprising a gate, responsive to said verifying means, for selectively blocking and permitting passage therethrough of vehicles passing through said toll system.

3. The toll system of claim 2, wherein said gate is further for blocking passage of said vehicle through said toll system when said determining means determines that said order of said vehicles passing through said vehicle type discriminator fails to match said order of vehicles passing through said communication area.

4. The toll system of claim 1, wherein said communication means is for forming said communication area downstream of said vehicle type discriminator, and for transmitting a signal, corresponding to a type of vehicles, to devices on vehicles in said communication area after said vehicles enter said communication area, in an order of passage through said vehicle type discriminator.

5. The toll system of claim 1, wherein a downstream end of said communication area is approximately perpendicular to a direction of vehicle travel therethrough.

6. The toll system of claim 1, further comprising:

entry detecting means for detecting entry of vehicles into said communication area, reception checking means for checking whether said communication means receives said vehicle type data from said device on said vehicle within a predetermined period of time since detection of entry of said vehicle into said communication area by said entry detecting means; and a memory for storing said vehicle type discriminating data if said reception checking means determines that said communication means has not received said vehicle type data within said predetermined period of time;

wherein said determining means is for comparing said vehicle type data with said vehicle type discriminating data stored in said memory if said reception means determines said communication means receives said vehicle type data after expiration of said predetermined period of time in order to determine whether said order of said vehicles passing through said vehicle type discriminator matches said order of said vehicles passing through said communication area.

7. The toll system of claim 1, wherein:

said communication means is disposed above a road of said toll system to form said communication area downwardly therefrom; and said communication means includes an antenna for communicating with said devices provided on vehicles in said communication area.

8. The toll system of claim 1, wherein said communication means is further for transmitting different data for toll collection to said devices provided on vehicles in a predetermined sequence.

9. The toll system of claim 1, wherein said devices provided on vehicles store data transmitted from said communication means.

10. The toll system of claim 1, wherein said devices provided on vehicles are for starting to communicate with said communication means responsive to reception data transmitted from said communication means.

* * * * *